United States Patent [19]

Yagihara et al.

[11] Patent Number: 4,842,993

[45] Date of Patent: Jun. 27, 1989

[54] METHOD FOR PROCESSING SILVER HALIDE COLOR PHOTOGRAPHIC MATERIAL

[75] Inventors: Morio Yagihara; Hiroshi Fujimoto; Takatoshi Ishikawa; Kazuto Andoh, all of Kanagawa, Japan

[73] Assignee: Fuji Photo Film Co., Ltd., Kanagawa, Japan

[21] Appl. No.: 164,368

[22] Filed: Mar. 4, 1988

[30] Foreign Application Priority Data

Mar. 4, 1987 [JP] Japan ..... 62-49082

[51] Int. Cl.[4] ..... G03C 7/30

[52] U.S. Cl. ..... 430/380; 430/434; 430/435; 430/441; 430/464; 430/467; 430/484; 430/485; 430/489; 430/490

[58] Field of Search ..... 430/380, 434, 435, 441, 430/464, 467, 489, 490, 468, 484, 485

[56] References Cited

U.S. PATENT DOCUMENTS 4,748,105 5/1988 Kadota et al. ..... 430/393

FOREIGN PATENT DOCUMENTS 213710 3/1987 European Pat. Off. .
243866 11/1987 European Pat. Off. .
115159 5/1987 Japan .
123459 6/1987 Japan .
275258 11/1987 Japan .
4234 3/1988 Japan .
4235 7/1988 Japan .

*Primary Examiner*—Paul R. Michl
*Assistant Examiner*—Patrick Doody
*Attorney, Agent, or Firm*—Sughrue, Mion, Zinn, Macpeak, and Seas

[57] ABSTRACT

A method for processing a silver halide color photographic material is described, which comprises treating said material after imagewise exposure with a color developer containing an aromatic primary amine developing agent and at least one compound represented by formula (I)

(I)

in which $X_1$ and $X_2$ each represents a divalent organic group. In accordance with this method, the stability and color-forming capacity of the color developer are remarkably improved, the increment of fog during continuous processing of photographic material is greatly reduced, and the color developer need not substantially contain benzyl alcohol.

18 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and in particularly to a method wherein the stability of the color developer is improved, the coloring property of the material is also improved, and the increase of the fog is remarkably reduced during continuous processing.

BACKGROUND OF THE INVENTION

A color developer containing an aromatic primary amine color developing agent has hitherto been utilized for the formation of photographic color images, and at present, and continues to have a main role in image formation methods in color photography. However, the color developer has a problem in that it is extremely easily oxidized in the presence of air or metals, and it is well known that the use of the oxidized developer for the formation of color images can cause an increase of fog and fluctuation of the sensitivity or gradation, with the result that the desired photographic characteristics can not be obtained.

Under the situation, various means have heretofore been investigated so as to improve the preservability of color developers, and among them, a method of using both hydroxylamine and a sulfite ion is most general. However, the hydroxylamine yields ammonia, which, when decomposed, causes the generation of fog, while the sulfite ion also is a problem, in that it acts as a competing compound for the developing agent, to interfere with the coloring property thereof. Accordingly, it is difficult to say that both of these compounds are preferred as the compound (preservative) for improving the preservability of the color developer. In particular, when the sulfite ion is used in a system not containing benzyl alcohol, which is harmful during preparation of the developing solution (developer) in view of environmental pollution problems, this causes an extreme lowering of the color density of the image formed.

As a compound capable of being used in place of sulfites, the alkanolamines described in Japanese Patent Application (OPI) No. 3532/79 (the term "OPI" as used herein means a "published unexamined Japanese patent application") and the polyethylene imines described in Japanese Patent Application (OPI) No. 94349/81 have been proposed, but even these compounds could not attain a fully satisfactory result.

In particular, a color photographic material having a silver chlorobromide emulsion with a high chlorine content is often fogged during color development (Japanese Patent Application (OPI) Nos. 95345/83 and 232342/84. Accordingly, when such emulsion is used, a preservative is indispensable which has a low solubility in the emulsion and which has a higher preserving function. However, a fully effective preservative has not yet been found.

SUMMARY OF THE INVENTION

One object of the present invention is to provide a method for processing a silver halide color photographic material with a color developer in which the stability of the color developer is elevated.

Another object of the present invention is to provide a method for processing a silver halide color photographic material with a color developer in which the elevation of the fog of the material during continuous processing can be remarkably reduced.

Still another object of the present invention is to provide a method for processing a silver halide color photographic material with a color developer in which the coloring property of the matrial is excellent even when the color developer does not substantially contain benzyl alcohol.

The above-mentioned objects can be attained by a method for processing a silver halide color photographic material, which comprises treating said material after imagewise exposure with a color developer containing an aromatic primary amine color developing agent and at least one compound represented by formula (I)

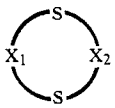

(I)

in which $X_1$ and $X_2$ (which may be same or different) each represents a divalent organic group.

DETAILED DESCRIPTION OF THE INVENTION

More preferably, $X_1$ and $X_2$ each represents an alkylene group having from 2 to 10 carbon atoms (e.g., a dimethylene group, a trimethylene group, a tetramethylene group, a methyltrimethylene group, etc.); an alkenylene group having from 2 to 10 carbon atoms (e.g., an ethylene group, a propenylene group, a butenylene group, etc.); an arylene group having from 6 to 10 carbon atoms (e.g., a phenylene group); or a group comprising a combination of said groups (e.g.,

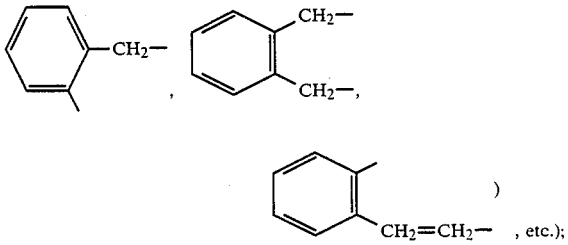

or $X_1$ and $X_2$ together with sulfur atoms form a 6- to 10-membered ring.

$X_1$ and $X_2$ may have substituent(s), which are, for example, selected from a halogen atom (e.g., a fluorine atom, a chlorine atom, a bromine atom, etc.), an alkyl group (e.g., a methyl group, an ethyl group, a t-butyl group, a methoxyethyl group, etc.), an aryl group (e.g., a phenyl group, a tolyl group, etc.), an alkoxy group (e.g., a methoxy group, an ethoxy group, a methoxyethoxy group, etc.), an aryloxy group (e.g., a phenoxy group, a p-nitrophenoxy group, etc.), a sulfonyl group (e.g., a methanesulfonyl group, a phenylsulfonyl group, etc.), a sulfonamido group (e.g., a methanesulfonamido group, a benzenesulfohamido group, etc.), a sulfamoyl group (e.g., an unsubstituted sulfamoyl group, a dimethylsulfamoyl group, etc.), a carbamoyl group (e.g., an unsubstituted carbamoyl group, a methylcarbamoyl group, a dimethylcarbamoyl group, etc.), an amido group (e.g., an acetamido group, a benzamido group, etc.), a ureido group (e.g., a methylureido group, a phenylureido group, etc.), an alkoxycarbonylamino group (e.g., a methoxycarbonylamino group, etc.), an acyl group (e.g., an acetyl group, a benzoyl group, etc.), a formyl group, a cyano group, a carboxyl group, a sulfo group, a hydroxyl group, a nitro group, an alkylthio group (e.g., a methylthio group, a carboxymethylthio group, etc.), an arylthio group (e.g., a phenylthio group, etc.), an amino group (e.g., an unsubstituted amino group, a dimethylamino group, etc.), etc. When $X_1$ and/or $X_2$ has(have) two or more substituents, the substituents may be same or different. In addition, these substituents may further be substituted.

Among the divalent organic groups for $X_1$ and $X_2$, the alkylene group having from 2 to 10 carbon atoms is preferred.

Among the compounds of the formula (I), especially preferred are those represented by formula (I-I)

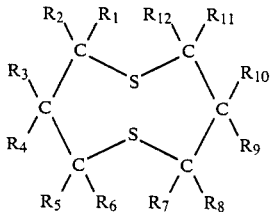

(I-I)

in which $R_1$ to $R_{12}$ each represents a hydrogen atom or a substituent as defined for $X_1$ and $X_2$, and $R_1$ to $R_{12}$ each is preferably a hydrogen atom, a halogen atom, an alkyl group, an alkoxy group, a hydroxyl group, a carboxyl group, a sulfo group, a nitro group or an alkylthio group. The carbon number of each of $R_1$ to $R_{12}$ is preferably from 1 to 10 and more preferably from 1 to 5.

Specific examples of the compounds represented by formula (I) are shown below, which, however, are not limitative.

I-1

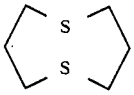

I-2

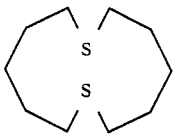

I-3

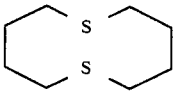

I-4

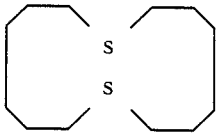

I-5

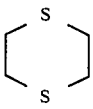

-continued

I-6

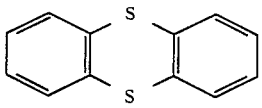

I-7

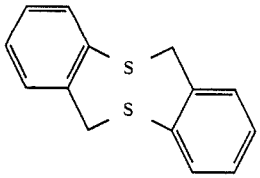

I-8

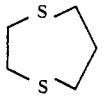

I-9

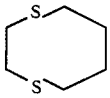

I-10

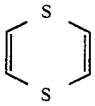

I-11

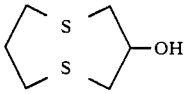

I-12

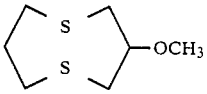

I-13

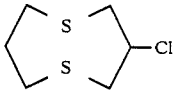

I-14

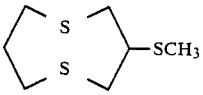

I-15

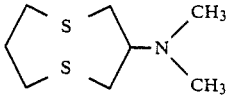

I-16

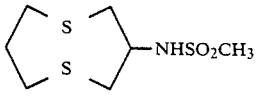

I-17

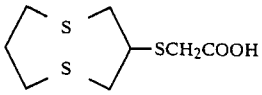

I-18

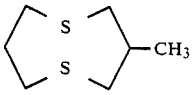

The compounds represented by formula (I) can be produced in accordance with the methods described in *Aust. J. Chem.*, 1979, No. 32, pp. 2777–81; *Inorg. Chem.*, 1984, No. 23, pp. 3266–3269; *J. Amer. Chem. Soc.*, 1978, 100 (20), pp. 6416–21; *J. Org. Chem.*, 1983, No. 48, pp. 3707–3712; *Indian. J. Chem.*, 10 (8), pp. 812–14; etc.

The content of the compound of formula (I) in the color developer is preferably from 0.05 g to 50 g, and more preferably from 0.1 g to 20 g, per liter of the developer.

It is preferred that the compound of formula (I) is incorporated into the developer in an amount of from 0.1 to 100 mols per mol of the aromatic primary amine developing agent.

The color developer for use in the present invention is explained in detail hereinafter.

The color developer for use in the present invention contains a known aromatic primary amine color developing agent. Preferred examples of the developing agent are p-phenylenediamine derivatives, and specific examples thereof are mentioned below, which are not limitative.

D-1: N,N-diethyl-p-phenylenediamine

D-2: 4-{N-ethyl-N-(β-hydroxyethyl)amino}aniline

D-3: 2-Methyl-4-{N-ethyl-N-(β-hydroxyethyl-)amino}aniline

D-4: 4-Amino-3-methyl-{N-ethyl-N-(β-methanesulfonamidoethyl)}aniline

These p-phenylenediamine derivatives can be in the form of salts thereof, such as sulfates, hydrochlorides, sulfites, p-toluenesulfonates, etc. The amount of aromatic primary amine developing agent in the developer is preferably from about 0.1 g to about 20 g, and more preferably from about 0.5 g to about 10 g, per liter of the developer.

In particular, the developer D-4 is preferred, since the increase of fog is small and a good photographic characteristic can be obtained when this is used in the presence of the compound of formula (I).

The compounds of the present invention have excellent preserving capacity in the processing system using an aromatic primary amine color developing agent, when used together with a compound capable of directly stabilizing the developing agent. As a compound capable of directly stabilizing the developing agent, a watersoluble antioxidant is generally known, and, examples include hydroxylamines and other compounds which are described below.

As the compound which can be incorporated into the color developer for use in the present invention, hydroxylamines are preferred, and especially preferred compounds represented by formula (II) are especially preferred.

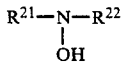

(II)

in which $R^{21}$ and $R^{22}$ each represents a hydrogen atom, an unsubstituted or substituted alkyl group, an unsubstituted or substituted alkenyl group, or an unsubstituted or substituted aryl group.

It is preferred that $R^{21}$ and $R^{22}$ each represents an alkyl group or an alkenyl group, and it is more preferred that at least one of them has substituent(s). $R^{21}$ and $R^{22}$ may be bonded to form a heterocyclic ring together with the nitrogen atom in the formula.

The alkyl group and alkenyl group may be straight chain, branched chain, or cyclic, and as the substituents for the said groups include a halogen atom, an aryl group (e.g., a phenyl group, a p-chlorophenyl group, etc.), an alkoxy group (e.g., a methoxy group, an ethoxy group, a methoxyethoxy group, etc.), an aryloxy group (e.g., a phenoxy group, etc.), a sulfonyl group (e.g., a methanesulfonyl group, a p-toluenesulfonyl group, etc.), a sulfonamido group (e.g., a methanesulfonamido group, a benzenesulfonamido group, etc.), a sulfamoyl group (e.g., diethylsulfamoyl group, an unsubstituted sulfamoyl group, etc.), a carbamoyl group (e.g., an unsubstituted carbamoyl group, a diethylcarbamoyl group, etc.), an amido group (e.g., an acetamido group, a benzamido group, etc.), a ureido group (e.g., a methylureido group, a phenylureido group, etc.), an alkoxycarbonylamino group (e.g., a methoxycarbonylamino group, etc.), an aryloxycarbonylamino group (e.g., a phenoxycarbonylamino group, etc.), an alkoxycarbonyl group (e.g., a methoxycarbonyl group, etc.), an aryloxycarbonyl group (e.g., a phenoxycarbonyl group, etc.), a cyano group, a hydroxyl group, a carboxyl group, a sulfo group, a nitro group, an amino group (e.g., an unsubstituted amino group, a diethylamino group, etc.), an alkylthio group (e.g., methylthio group, etc.), an arylthio group (e.g., a phenylthio group, etc.) and a heterocyclic group (e.g., a morpholyl group, a pyridyl group, etc.). $R^{21}$ and $R^{22}$ may be same or different, and the substituent(s) for $R^{21}$ and $R^{22}$ also may be same or different.

The carbon number of each of $R^{21}$ and $R^{22}$ is preferably from 1 to 10, and more preferably from 1 to 5. As the nitrogen-containing heterocyclic ring to be formed by the combination of $R^{21}$ and $R^{22}$, there are a piperidyl group, a pyrrolidyl group, an N-alkylpiperazyl group, a morpholyl group, an indolinyl group, a benztriazolyl group, etc.

Preferred substituents for $R^{21}$ and $R^{22}$ are a hydroxyl group, an alkoxy group, a sulfonyl group, an amido group, a carboxyl group, a cyano group, a sulfo group, and a nitro group.

Specific examples of compound represented by formula (II) which can be used in the present invention are set forth below, which, however, are not intended to limit the scope of the present invention.

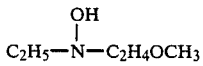

II-(1)

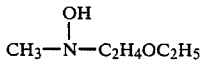

II-(2)

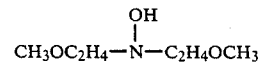

II-(3)

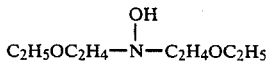

II-(4)

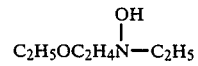

II-(5)

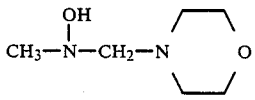

II-(6)

-continued

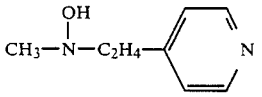

II-(8)

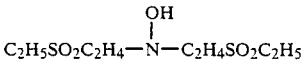

II-(9)

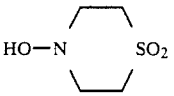

II-(10)

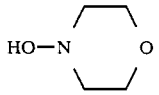

II-(11)

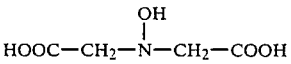

II-(13)

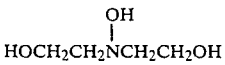

II-(14)

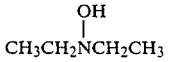

II-(15)

$NH_2OH$

II-(16)

Other examples of the compounds represented by formula (II) are described in the following patent publications, and the compounds represented by formula (II) can be produced by known methods, for example, the methods described in these patent publications. The patent publications are U.S. Pat. Nos. 3,661,996, 3,362,961 and 3,293,034, Japanese Patent Publication No. 2794/67, U.S. Pat. Nos. 3,491,151, 3,655,764, 3,467,711, 3,455,916, 3,287,125, and 3,287,124.

These compounds can be in the form of salts of various acids, such as hydrochloric acid, sulfuric acid, nitric acid, phosphoric acid, oxalic acid, acetic acid, etc. Other "compounds capable of directly stabilizing developing agents" which are preferably used together with the compounds of the present invention (i.e., other than the said hydroxylamines) include, for example, hydrazines, hydrazides, phenols, saccharides, hydroxamic acids, α-aminoketones, α-hydroxyketones, etc.

These compounds are described in further detail hereinafter.

The hydroxamic acids are preferably those represented by formula (III)

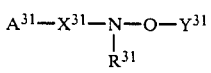

(III)

in which $A^{31}$ represents a hydrogen atom, an alkyl group, an aryl group, an amino group, a heterocyclic group, an alkoxy group, an aryloxy group, a carbamoyl group, a sulfamoyl group, an acyl group, a carboxyl group, a hydroxyamino group or a hydroxyaminocarbonyl group.

These groups may be substituted, and examples of the substituents for the said groups include a halogen atom, an aryl group, an alkyl group, an alkoxy group, an aryloxy group, a hydroxyl group, a sulfonyl group, a sulfonamido group, a sulfamoyl group, a sulfo group, an amido group, a ureido group, a cyano group, a hydroxyaminocarbonyl group, a carboxyl group, a nitro group, an amino group, an alkoxycarbonyl group, an aryloxycarbonyl group, an alkylthio group, an arylthio group, a heterocyclic group (e.g., a pyridyl group, a morpholino group, etc.), etc.

Preferably, $A^{31}$ represents a substituted or unsubstituted alkyl, aryl, amino, alkoxy, or aryloxy group. Especially preferably, $A^{31}$ represents a substituted or unsubstituted amino, alkoxy, or aryloxy group. The carbon number of $A^{31}$ is preferably from 1 to 10.

$X^{31}$ represents

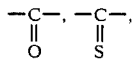

$—SO_2—$, or —SO—. Preferably, $X^{31}$ represents

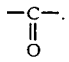

$R^{31}$ represents a hydrogen atoms, an alkyl group or an aryl group. $A^{31}$ and $R^{31}$ may optionally be bonded together to form a cyclic structure. $R^{31}$ may have a substituent(s), and as examples of such substituents, the same substituents as those described for $A^{31}$ can be noted. Most preferably, $R^{31}$ represents a hydrogen atom.

$Y^{31}$ represents a hydrogen atom or a group capable of becoming a hydrogen atom by hydrolysis.

Specific examples of the group for $Y^{31}$, which can become a hydrogen by hydrolysis, are as follows:

(1) $Y^{31}$ is protected by an ester bond or a urethane bond, that is, $Y^{31}$ represents

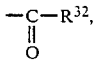

in which $R^{32}$ represents for example, an alkyl group, an aryl group, or an amino group.

(2) $Y^{31}$ is protected by the imidomethyl-blocking group described in Japanese Patent Application (OPI) No. 158638/82, or, that is, $Y^{31}$ represents

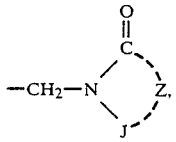

in which J represents

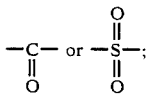

and Z represents a group of atoms completing a heterocyclic ring having at least one 5- or 6-membered ring.

Examples of such compound are shown below, which, however, are not limitative.

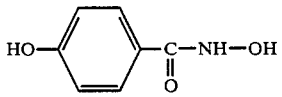

(III)-1

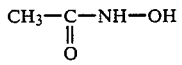

(III)-2

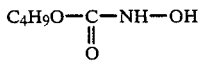

(III)-3

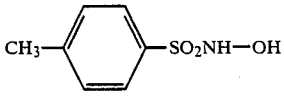

(III)-4

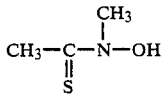

(III)-5

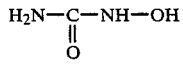

(III)-6

Other examples of the compound represented by formula (III) are described, e.g., in Japanese Patent Application No. 186559/86, and these can be obtained in accordance with the method described in said patent application.

The hydrazines and hydrazides which can be used in the present invention are preferably represented by formula (IV)

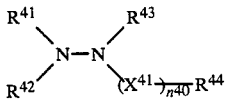

(IV)

in which $R^{41}$, $R^{42}$, and $R^{43}$ each represents a hydrogen atom, an alkyl group (preferably having from 1 to 20 carbon atoms, such as a methyl group, an ethyl group, a sulfopropyl group, a carboxybutyl group, a hydroxyethyl group, etc.), an aryl group (preferably having from 6 to 20 carbon atoms, such as a phenyl group, a 2,5-dimethoxyphenyl group, a 4-hydroxyphenyl group, a 2-carboxyphenyl group, etc.), or a heterocyclic group (preferably having from 1 to 20 carbon atoms, such as a pyridin-4-yl group, etc.);

$R^{44}$ represents a hydroxyl group, a hydroxylamino group, an alkyl group (preferably having from 1 to 20 carbon atoms, such as a methyl group, an ethyl group, a sulfopropyl group, a carboxybutyl group, a hydroxyethyl group, a cyclohexyl group, a benzyl group, etc.), an aryl group (preferably having from 6 to 20 carbon atoms, such as a phenyl group, a 2,5-dimethoxyphenyl group, a 4-hydroxyphenyl group, a 2-carboxyphenyl group, etc.), a heterocyclic group (preferably having from 1 to 20 carbon atoms, such as a pyridin-4-yl group, etc.), an alkoxy group (preferably having from 1 to 20 carbon atoms, such as a methoxy group, an ethoxy group, a methoxyethoxy group, a benzyloxy group, a cyclohexyloxy group, etc.), an aryloxy group (preferably having from 6 to 20 carbon atoms, such as a phenoxy group, a p-methoxyphenoxy group, etc.), a carbamoyl group, (preferably having from 1 to 20 carbon atoms, such as a carbamoyl group, an N,N-diethylcarbamoyl group, a hydrazinocarbonyl group, etc.), or an amino group (preferably having 20 or less carbon atoms, such as an amino group, an N-phenylamino group, a hydrazino group, etc.);

$X^{41}$ represents a divalent group selected from —CO—, —$SO_2$—, or

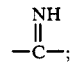

$n^{40}$ represents 0 or 1, and, in particular, when $n^{40}$ is 0, then $R^{44}$ represents a group selected from an alkyl group, an aryl group, and a heterocyclic group; or $R^{43}$ and $R^{44}$ together form a heterocyclic ring, and such $R^{43}$ and $R^{44}$ may further be substituted by substituent(s).

In formula (IV), preferably $R^{41}$, $R^{42}$, and $R^{43}$ each is a hydrogen atom or an alkyl group; and most preferably, $R^{41}$ and $R^{42}$ are hydrogen atoms.

In the formula (IV), $R^{44}$ preferably represents an alkyl group, an aryl group, an alkoxy group, a carbamoyl group, or an amino group; $X^{41}$ is more preferably —CO— or —$SO_2$—, and is most preferably —CO—.

Specific examples of the compound of formula (IV) are shown below, which, however, are not limitative.

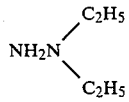

(N-1)

$NH_2NH(CH_2)_4SO_3H$ (N-2)

$NH_2NH(CH_2)_2OH$ (N-3)

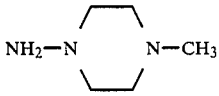

(N-4)

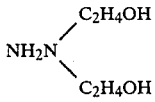

(N-5)

$NH_2NHCOCH_3$ (N-6)

$NH_2NHCOOC_2H_5$ (N-7)

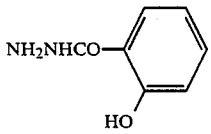

(N-8)

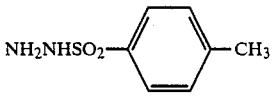

(N-9)

$NH_2NHCONH_2$ (N-10)

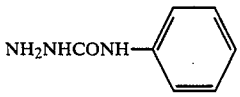

(N-11)

$NH_2NHSO_3H$ (N-12)

-continued $$NH_2NHC(=NH)NH_2 \quad \text{(N-13)}$$

$$NH_2NHCOCONHNH_2 \quad \text{(N-14)}$$

Other examples of the compound represented by formula (IV) are described, e.g., in Japanese Patent Application No. 170756/86, and these can be obtained in accordance with the method described in said patent application.

The phenols which can be used in the present invention are preferably represented by formula (V)

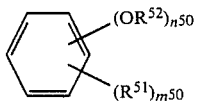

(V)

Therein $R^{51}$ represents a hydrogen atom, a halogen atom, an alkyl group (e.g., a methyl group, an ethyl group, a t-butyl group, etc.), an aryl group (e.g., a phenyl group, etc.), an alkoxy group (e.g., a methoxy group, an ethoxy group, etc.), an aryloxy group (e.g., a phenoxy group, etc.), a carboxyl group, a sulfo group, a carbamoyl group, a sulfamoyl group, an amido group (e.g., an acetamido group, a benzamido group, etc.), a sulfonamido group (e.g., a methanesulfonamido group, a benzenesulfonamido group, etc.), a ureido group, an alkylthio group (e.g., a methylthio group, etc.), an arylthio group (e.g., a phenylthio group, etc.), a nitro group, a cyano group, an amino group, a formyl group, an acyl group (e.g., an acetyl group, etc.), a sulfonyl group.(e.g., a methanesulfonyl group, a benzenesulfonyl group, etc.), an alkoxycarbonyl group (e.g., a methoxycarbonyl group, etc.), an aryloxycarbohyl group (e.g., a phenoxycarbonyl group, etc.), an alkoxysulfonyl group (e.g., a methoxysulfonyl group, etc.), or an aryloxysulfonyl group (e.g., a phenoxysulfonyl group, etc.). When $R^{51}$ is further substituted, the substitutents include a halogen atom, an alkyl group, an aryl group, a hydroxyl group, an alkoxy group, an aryloxy group, a carboxyl group, a sulfo group, a carbamoyl group, a sulfamoyl group, an amido group, a sulfonamido group, a ureido group, an alkylthio group, an arylthio group, a nitro group, a cyano group, an amino group, a formyl group, an acyl group, a sulfonyl group, an alkoxycarbonyl group, an aryloxycarbonyl group, an alkoxysulfonyl group, an aryloxysulfonyl group, a heterocyclic group (e.g., a morpholyl group, a pyridyl group, etc.), etc. $R^{51}$ may have two or more same or different kinds of these substituents. When $R^{51}$ have two or more substituents (that is, when m is two or more), the kind of the substituents may be same or different, and when the substituents are adjacent to each other, these may be bonded to form a ring. The ring structure is a 5- or 6-membered ring, which is composed of carbon, hydrogen, halogen, oxygen, nitrogen and/or sulfur atoms, etc., and the ring may be saturated or unsaturated. In the group $R^{51}$ and the substituent(s), the carboxyl group and the sulfo group may be in the form of a salt with an alkali metal (e.g., Na, K, etc.), and the amino group may also form a salt with various kinds of acids, such as hydrochloric acid, etc.

Also in the formula (V), $R^{52}$ represents a hydrogen atom or a hydrolyzable group. The hydrolyzable group means a group which can be hydrolyzed to a hydrogen atom, and examples of the group include

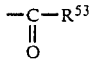

(in which $R^{53}$ represents an alkyl group, an aryl group, or an amino group). That is, the hydrolyzable group is a group as protected by an ester bond or an urethane bond. Another example of the group is a group as protected by the imidomethyl-blocking group described in Japanese Patent Application (OPI) No. 158638/82. That is, the group is represented by the formula

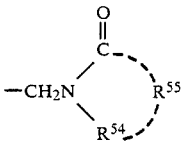

in which $R^{54}$ represents

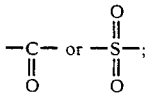

$R^{55}$ represents a group of atoms completing a heterocyclic ring having at least one 5- or 6-membered ring. In formula (V), $m^{50}$ and $n^{50}$ each represent an integer of from 1 to 5.

In formula (V), $R^{51}$ is preferably an alkyl group, halogen atom, an alkoxy group, an alkylthio group, a carboxyl group, a sulfo group, a carbamoyl group, a sulfamoyl group, an amino group, an amido group, a sulfonamido group, a nitro group or a cyano group, and among these, an alkoxy group, an alkylthio group, an amino group and a nitro group are particularly preferred as $R^{51}$. $R^{51}$ is more preferably positioned at ortho- or para-position to the group $-OR^{52}$. The carbon number of the group $R^{51}$ is preferably from 1 to 10, and especially preferably from 1 to 6.

Preferably, $R^{52}$represents a hydrogen atom or a hydrolyzable group having from 1 to 5 carbon atoms. When two or more groups $OR^{52}$ are present in the benzene nucleus (that is, when $n^{50}$ is two or more), these are preferably ortho- or para-positioned to each other.

Specific examples of the compound represented by formula (V) are shown below, which, however, are not limitative.

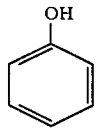

V-1

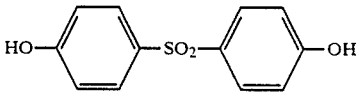

V-2

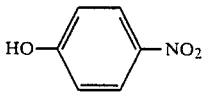

V-3

-continued

V-4

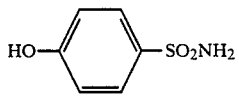

V-5

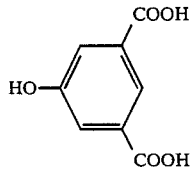

V-6

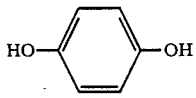

V-7

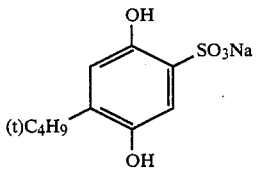

V-8

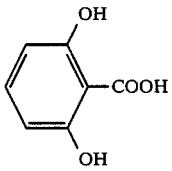

V-9

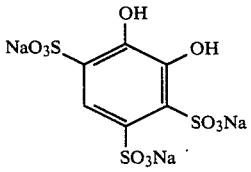

V-10

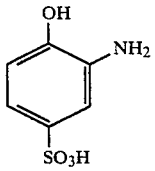

V-11

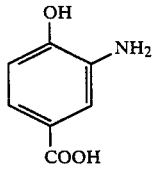

Other examples of the compound of the formula (V) are described in Japanese Patent Application Nos. 188742/86 and 203253/86, and these can be obtained in accordance with the method described in the said patent applications.

The α-hydroxyketones and α-aminoketones which can be used in the present invention are preferably represented by formula (VI)

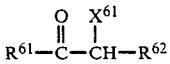

(VI)

in which $R^{61}$ represents a hydrogen atom, an alkyl group (preferably having from 1 to 20 carbon atoms, such as a methyl group, an ethyl group, a hydroxymethyl group, a methoxyethyl group, a cyclohexyl group, etc.), an aryl group (preferably having from 6 to 20 carbon atoms, such as a phenyl group, a 2-hydroxyphenyl group, etc.), an alkoxy group (preferably having from 1 to 20 carbon atoms, such as a methoxy group, an ethoxy group, a methoxyethoxy group, etc.), an aryloxy group, (preferably having from 6 to 20 carbon atoms, such as a phenoxy group, a 4-methoxyphenoxy group, etc.), or an amino group (preferably having 20 or less carbon atoms, such as an amino group, an N,N-diethylamino group, an N-phenylamino group, etc.);

$R^{62}$ represents a hydrogen atom, an alkyl group (preferably having from 1 to 20 carbon atoms, such as a methyl group, an ethyl group, a hydroxymethyl group, etc.), or an aryl group (preferably having from 6 to 20 carbon atoms, such as a phenyl group, a 2-hydroxyphenyl group, etc.); or $R^{61}$ and $R^{62}$ together form a carbocyclic ring or a heterocyclic ring;

$X^{61}$ represents a hydroxyl group or an amino group (preferably having 20 or less carbon atoms, such as an amino group, an N,N-diethylamino group, a morpholino group, etc.).

In formula (VI), $R^{61}$ is preferably a hydrogen atom, an alkyl group, an aryl group, or an alkoxy group; and $R^{62}$ is preferably a hydrogen atom or an alkyl group.

Specific examples of the compound of the formula (VI) are shown below, which, however, are not limitative.

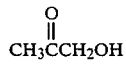

(VI-1)

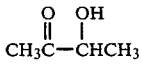

(VI-2)

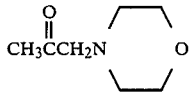

(VI-3)

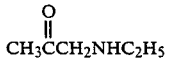

(VI-4)

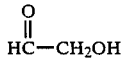

(VI-5)

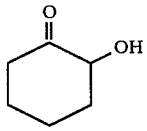

(VI-6)

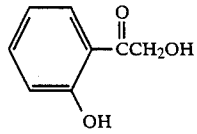

(VI-7)

-continued

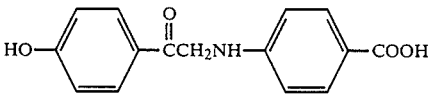

(VI-8)

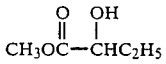

(VI-9)

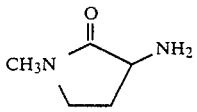

(VI-10)

Other examples of the compound of the formula (VI) are described, e.g., in Japanese Patent Application No. 188741/86, and these can be obtained in accordance with the method described in said patent application.

Next, the "saccharides" which can be used in the present invention is explained in detail hereunder.

The saccharides (which are also called "carbohydrate") include monosaccharides and polysaccharides, and most of them are represented by formula $C_nH_{2n}O_m$. The monosaccharides generically include aldehydes or ketones of polyhydric alcohols (which are called "aldoses" and "ketoses," respectively) as well as the reduced derivatives, oxidized derivatives and dehydrated derivatives, thereof, aminosaccharides and thio-saccharides, and other derivatives of a broad range. "Polysaccharides" as used herein refers to reaction products formed by dehydration condensation of two or more of the said monosaccharides.

Among these saccharides, reducing aldehyde group-containing aldoses and derivatives thereof are preferred, and in particular, the corresponding monosaccharides are more preferred.

Specific examples of the saccharides which can be used in the present invention are described below, which, however, are not limitative. In addition, the optical isomers of the saccharides can also be used in the same manner.

D-oxilose

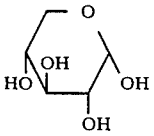

VII-1

L-arabinose

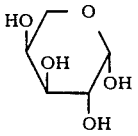

VII-2

D-ribose

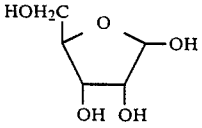

VII-3

D-deoxyribose

-continued

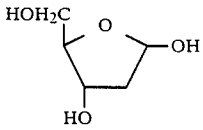

VII-4

D-glucose

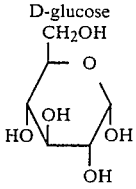

VII-5

D-galactose

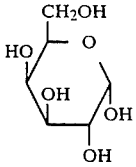

VII-6

D-mannose

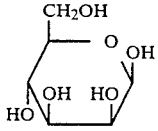

VII-7

Glucosamine

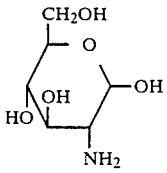

VII-8

L-sorbose

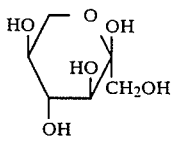

VII-9

D-sorbitol

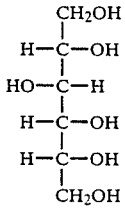

VII-10

The above-mentioned compounds are readily avaiable as commercial products.

The amount (total) of the compounds represented by formulae (III) to (VII) to be added to the color developer is preferably from 0.01 g to 20 g, and more preferably from 0.5 g to 10 g, per liter of the color developer.

As preservatives, sulfites such as sodium sulfite, potassium sulfite, sodium bisulfite, potassium bisulfite, sodium metabisulfite, potassium metabisulfite, etc., as well as carbonyl-sulfite adducts can also be added to the color developer, if desired. The amount of the said preservatives to be added to the color developer may be 20 g/liter or less, and preferably 5 g/liter or less, and the amount is preferred to be smaller, provided that the preservation of the color developer can be ensured to be good.

In addition, the color developer may further contain other preservatives, such as various kinds of metals described in Japanese Patent Application (OPI) Nos. 44148/82 and 53749/82, etc.; various kinds of saccharides described in Japanese Patent Application (OPI) No. 102727/77, etc.; the $\alpha,\alpha'$-dicarbonyl compounds described in Japanese Patent Application (OPI) No. 160141/84, etc.; the salicyclic acids described in Japanese Patent Application (OPI) No. 180588/84, etc.; the gluconic acid derivatives described in Japanese Patent Application (OPI) No. 75647/81, etc., if desired. Two or more kinds of these preservatives may be used together, if desired. In particular, the addition of aromatic polyhydroxy compounds is preferred.

The color developer for use in the present invention preferably has a pH value of from 9 to 12, and more preferably from 9 to 11.0, and the color developer can contain various known developer components in addition to the above-mentioned ingredients.

In order to maintain the a proper pH value, the color developer preferably contains various kinds of buffers. The buffers which are usable include, for example, carbonic acid salts, phosphoric acid salts, boric acid salts, tetraboric acid salts, hydroxy-benzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, tris-hydroxyaminomethane salts, lysine salts, etc. In particular, carbonic acid salts, phosphoric acid salts, tetraboric acid salts and hydroxybenzoic acid salts are advantageous in that these are excellent in solubility and have an excellent buffering capacity in a high pH range of pH 9.0 or more, and therefore even when they are added to the color developer, these have no bad influence on the photographic properties (for example, fog. etc.). In addition, they are inexpensive. Accordingly, the use of such buffers is especially preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicyalte), potassium 5-sulfo-2-hydroxybenzoate (potassium 5-sulfosalicylate), etc. However, these compounds are not intended to restrict the scope of the present invention.

The amount of the said buffer to be added to the color developer is preferably 0.1 mol/liter or more, and is especially preferably from 0.1 mol/liter to 0.4 mol/liter.

In addition, the color developer can further contain various kinds of chelating agents as a flocculation (precipitation)-preventing agent with respect to calcium or magnesium, or for the purpose of improving the stability of the color developer.

As the chelating agent, organic acid compounds are preferred, and for example, there may be mentioned the aminopolycarboxylic acids described in Japanese Patent Publication Nos. 30496/73 and 30232/69, etc.; the organic phosphonic acids described in Japanese Patent Application No. 97347/81, Japanese Patent Publication No. 39359/81, West German Pat. No. 2,227,639, etc.; the phosphonocarboxylic acids described in Japanese Patent Application (OPI) Nos. 102726/77, 42730/78, 121127/79, 126241/80 and 659506/80, etc.; and the compounds described in Japanese Patent Application Nos. 195845/83 and 203440/83, Japanese Patent Publication No. 40900/78, etc.

Specific examples of the compounds, which, however, are not limitative, include nitrilo-triacetic acid; diethylenetriamine-pentaacetic acid; ethylenediamine-tetraacetic acid; N,N,N-trimethylene-phosphonic acid; ethylenediamine-N,N,N',N'-tetramethylene-phosphonic acid; trans-cyclohexane-diamine-tetraacetic acid; 1,2-diaminopropanetetraacetic acid; glycolether-diamine-tetraacetic acid; ethylenediamine-orthohydroxyphenylacetic acid; 2-phosphonobutane-1,2,4-tricarboxylic acid; 1-hydroxyethylidene-1,1-diphosphonic acid; N,N'-bis(2-hydroxybenzyl)-ethylenediamine-N,N'-diacetic acid.

These chelating agents can be used in the form of a mixture of two or more kinds thereof.

The amount of the chelating agent to be added to the color developer may be a sufficient amount for blocking the metal ions in the developer. For example, the amount may preferably be from about 0.1 g to 10 g, per liter of the developer.

The color developer may contain an optional development accelerator, if desired. However, it is preferred that the color developer of the present invention does not substantially contain benzyl alcohol, in view of the prevention of environmental pollution, the ease of the preparation of the developer solution, and the prevention of fog. The terminology "does not substantially contain benzyl alcohol" means that the content of the benzyl alcohol in the developer is 2 ml/liter or less, or preferably the developer contains no benzyl alcohol.

The above-mentioned compounds of the present invention are extremely effective for improving the stability of even the color developer which does not substantially contain benzyl alcohol.

As the other development accelerators which can be added to the color developer for use in the present invention, there may be mentioned, for example, the thioether series compounds described in Japanese Patent Publication Nos. 16088/62, 5987/62, 7826/63, 12380/79 and 9019/70, U.S. Pat. No. 3,813,247, etc.; the p-phenylenediamine series compounds described in Japanese Patent Application (OPI) Nos. 49829/77 and 15554/75, etc.; the quaternary ammonium salts described in Japanese Patent Application (OPI) No. 137726/75, Japanese Patent Publication No. 30074/69, Japanese Patent Application (OPI) Nos. 156826/81 and 43429/77, etc.; the amine series compounds described in U.S. Pat. Nos. 2,494,903, 3,128,182, 4,230,796 and 3,253,919, Japanese Patent Publication No. 11431/66, U.S. Pat. Nos. 2,482,546, 2,596,926 and 3,582,346, etc.; the polyalkylene oxides described in Japanese Patent Publication Nos. 16088/62 and 25201/67, U.S. Pat. No. 3,128,183, Japanese Patent Publication Nos. 11431/66 and 23883/67, U.S. Pat. No. 3,532,501, etc.; as well as 1-phenyl-3-pyrazolidones, imidazoles, etc. These can be added to the developer, if desired.

In the practice of the present invention, any optional anti-foggant can be added to the color developer, if desired. As the anti-foggant can be used alkali metal halides such as sodium chloride, potassium bromide or potassium iodide as well as organic anti-foggants. Specific examples of the organic anti-foggants are nitrogen-containing heterocyclic compounds, including, for example, benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, adenine, etc.

The color developer for use in the present invention preferably contains a brightening agent. As the brightening agent are preferred 4,4'-diamino-2,2'-disulfostilbene series compounds. The amount of the brightening agent to be added to the color developer is up to 5 g/liter, and preferably from 0.1 to 4 g/liter.

In addition, various kinds of surfactants may be added to the color developer, if desired, including alkylsulfonic acids, arylsulfonic acids, aliphatic carboxylic acids, aromatic carboxylic acids. etc.

The processing temperature of the color developer of the present invention is from 20° to 50° C., and preferably from 30° to 40° C. The processing time is from 20 seconds to 5 minutes, and preferably from 30 seconds to 2 minutes. The amount of the replenisher is preferred to be smaller and is, for example, from 20 to 600 ml, preferably from 50 to 300 ml, and more preferably from 100 to 200 ml, per $m^2$ of the photographic light-sensitive material as being processed.

Next, the bleaching solution, bleach-fixing solution, and fixing solution for use in the present invention are explained hereunder.

Any and every bleaching agent can be used in the bleaching solution or bleach-fixing solution for use in the present invention. More particularly, organic complex salts of iron(III) (for example, complex salts with aminopolycarboxylic acids such as ethylenediaminetetraacetic acid, diethylenetriaminepentaacetic acid, etc., aminopolyphosphonic acids, phosphonocarboxylic acids or organic phosphonic acids); or organic acids such as citric acid, tartaric acid, malic acid, etc.; persulfates; hydrogen peroxide; etc., are preferred as the bleaching agent.

Among these, the organic complex salts of iron(III) are especially preferred in view of the rapid processability thereof, and in view of the prevention of environmental pollution. Examples of the aminopolycarboxylic acids, aminopolyphosphonic acids or organic phosphonic acids or their salts include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycoletherdiaminetetraacetic acid, etc.

These compounds may be in any form of their sodium, potassium, lithium or ammonium salts. Among these compounds, iron(III) complex salts of ethylenediaminetetraacetic acid, diethylenetriaminepentaacetic acid, cyclohexanediaminetetraacetic acid, 1,3-diaminopropanetetraacetic acid or methyliminodiacetic acid are especially preferred since these have a high bleaching capacity.

These ferric complex salts may be used in the form of the complex salts themselves or, alternatively, a ferric salt such as ferric sulfate, ferric chloride, ferric nitrate, ferric ammonium sulfate, ferric phosphate, etc., and a chelating agent such as aminopolycarboxylic acids, aminopolyphosphonic acids, phosphonocarboxylic acids, etc., can be added to the developing solution so that the intended ferric complex salt can be formed in the solution. The chelating agent can be used in an excess amount exceeding the necessary amount for the formation of the ferric complex salt. Among the iron complexes, the aminopolycarboxylic acid/iron complexes are preferred, and the amount of the complex to be added to the developer is generally from 0.01 to 1.0 mol/liter, and preferably from 0.05 to 0.50 mol/liter.

In the bleaching or bleach-fixing solution and/or the previous bath, various kinds of compounds can be used as a bleaching accelerating agent. For example, the mercapto group- or disulfido group-containing compounds described in U.S. Pat. No. 3,893,858, West German Pat. No. 1,290,812, Japanese Patent Application (OPI) No. 95630/78, *Research Disclosure* No. 17129 (July, 1978), etc.; the thiourea series compounds described in Japanese Patent Publication No. 8506/70, Japanese Patent Application (OPI) Nos. 20832/77 and 32735/78, U.S. Pat. No. 3,706,561, etc.; as well as halides such as iodides, bromides, etc., are preferred for the said purpose, as having an excellent bleaching capacity.

In addition, the bleach or bleach-fixing solution for use in the present invention can further contain rehalogenating agents, such as bromides (e.g., potassium bromide, sodium bromide, ammonium bromide, etc.), chloride (e.g., potassium chloride, sodium chloride, ammonium chloride, etc.), iodides (e.g., ammonium iodide, etc.), etc. Also, it can additionally contain one or more inorganic acids, organic acids, or alkali metal or ammonium salts thereof having a pH buffering capacity, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., as well as an anti-corrosive agent such as ammonium nitrate, guanidine, etc., if desired.

The fixing agent to be used in the bleach-fixing solution or fixing solution for use in the present invention may be a known fixing agent which is a water-soluble silver halide-dissolving agent, such as thiosulfates (e.g., sodium thiosulfate, ammonium thiosulfate, etc.); thiocyanates (e.g., sodium thiocyanate, ammonium thiocyanate, etc.); thioether compounds and thiourea compounds (e.g., ethylenebisthioglycolic acid, 3,6-dithia-1,8-octanediol, etc.), etc. These can be used singly or in the form of a mixture of two or more thereof. In addition, a special bleach-fixing solution comprising the combination of a fixing agent and a large amount of a halide such as potassium iodide, as described in Japanese Patent Application (OPI) No. 155354/80, can also be used in the present invention. In the practice of the present invention, the use of thiosulfates, especially ammonium thiosulfate, is preferred. The amount of the fixing agent in the solution is preferably from 0.3 to 2 mols, and more preferably from 0.5 to 1.0 mol, per liter of the solution. The pH range of the bleach-fixing solution or fixing solution is preferably from 3 to 10, and more preferably from 5 to 9.

The bleach-fixing solution can further contain various kinds of brightening agents, de-foaming agents, and surfactants, as well as organic solvents such as polyvinyl pyrrolidone, methanol, etc.

The bleach-fixing solution or fixing solution for use in the present invention contains, as a preservative, a sulfite ion-releasing compound, such as a sulfite (e.g., sodium sulfite, potassium sulfite, ammonium sulfite, etc.), bisulfite (e.g., ammonium bisulfite, sodium bisulfite, potassium bisulfite, etc.), metabisulfite (e.g., potassium metabisulfite, sodium metabisulfite, ammonium metabisulfite, etc.), etc. The compounds can be incorporated into the said solution in an amount of from about 0.02 to about 0.50 mol/liter, and more preferably from 0.04 to 0.40 mol/liter, as the sulfite ion.

As the preservative, the addition of the sulfites is generally used, but other compounds, such as ascorbic acids, carbonyl-bisulfite adducts, or carbonyl compounds can also be added.

In addition, a buffer, a brightening agent, a chelating agent, a de-foaming agent, a fungicide, etc., can also be added to the solution, if desired.

The silver halide color photographic material as processed by the method of the present invention is generally rinsed with water and/or stabilized, after the desilvering process such as the fixation or bleach-fixation, etc.

The amount of water to be used in the rinsing step can be set in a broad range, in accordance with the characteristic of the photographic light-sensitive material being processed (for example, depending upon the raw material components, such as coupler, etc.) or the use of the material, as well as the temperature of the rinsing water, the number of the rinsing tank (i.e., the number or the rinsing stage), the replenishment system of normal current or countercurrent and other various kinds of conditions. Among said conditions, the relation between the number of the rinsing tanks and the amount of the rinsing water in a multi-stage countercurrent rinsing system can be obtained, e.g., by the method described in *Journal of the Society of Motion Picture and Television Engineers,* Vol. 64, pages 248 to 253 (May, 1955). In general, the number of stages in a multi-stage countercurrent rinsing system is preferably from 2 to 6, and especially preferably is from 2 to 4.

According to the multi-stage countercurrent system, the amount of the rinsing water to be used can be reduced significantly, for example, to the level of from 1.0 liter or less and preferably from 0.5 liter or less per $m^2$ of the photographic light-sensitive material being processed. However, because of the prolongation of the residence time of the water in the rinsing tank, bacteria would propagate in the tank, so that the floating substances generated by the propagation of bacteria would adhere to the surface of the material as being processed. Accordingly, the system would often have a problem. In the practice of the present invention for processing color photographic materials, the method for reducing calcium and magnesium, which is described in Japanese Patent Application (OPI) No. 288838/87, can be extremely effectively be used for overcoming said problem. In addition, the isothiazolone compounds and thiabendazoles described in Japanese Patent Application (OPI) No. 8542/82; chlorine series bactericides such as the chlorinated sodium isocyanurates described in Japanese Patent Application (OPI) No. 120145/86, etc.; the benzotriazoles described in Japanese Patent Application (OPI) No. 267761/86; copper ion; and other bactericides described in H, Horiguchi, *Antibacterial and Antifungal Chemistry,* and *Bacteicidal and Fungicidal Techniques to Microorganisms,* edited by Association of Sanitary Technique, Japan, and *Encyclopeadia of Bactericidal and Fungicidal Agents,* edited by Nippon Bactericide and Fungicide Association, etc., can also be used.

In addition, a surfactant as a water-cutting agent, as well as a chelating agent such as EDTA as a hard water softening agent, can also be added to the rinsing water.

The pH value of the rinsing water to be used in the method of the present invention for processing photographic light-sensitive materials is from 4 to 9, and preferably from 5 to 8. The temperature of the rinsing water and the rinsing time can also be set variously in accordance with the characteristic of the photographic material as being processed, the use thereof, etc., and in general; the temperature is from 15° to 45° C. and the time is from 20 seconds to 10 minutes, and preferably, the temperature is from 25° to 40° C. and the time is from 30 seconds to 5 minutes.

Following the rinsing step, the material can be processed with a stabilizer solution, or alternatively, the material can be directly processed with a stabilizer solution without taking the rinsing step. To the stabilizer solution can be added a compound having an image stabilizing function. For example, aldehyde compounds such as formalin (aqueousformaldehyde solution), buffers for adjusting to the film pH value suitable for image stabilization as well as ammonium compounds can be added to the stabilizer solution. In addition, the above-mentioned various kinds of bactericides and fungicides can also be added to the stabilizer solution so as to prevent the propagation of bacteria in the solution or to impart a fungicidal capacity to the photographic material as processed.

Further, a surfactant, a brightening agent and a hardener can also be added to the stabilizer solution. In the practice of the present invention, when the stabilization step is directly carried out without the water-rinsing step, any and every known method, for example, the methods described in Japanese Patent Application (OPI) Nos. 8543/82, 14834/83, 184343/84, 220345/85, 238832/85, 239784/85, 239749/85, 4054/86 and 11879/86, etc. can be utilized.

In addition, a chelating agent such as 1-hydroxyethylidene-1,1-diphosphonic acid, ethylenediamine-tetramethylene-phosphonic acid, etc., as well as a magnesium or bismuth compound can also be used as a preferred embodiment.

The solution as used in the water-rinsing and/or stabilization step(s) can be used again in the previous step. As an example, there may be mentioned a process in which the overflow of the rinsing water, which has been reduced in the multi-stage countercurrent system, is returned backward to the previous bleach-fixing bath and a fresh concentrated solution is replenished into the bleach-fixing bath so as to decrease the amount of the resulting waste drainage.

The method of the present invention can be applied to any and every photographic processing which uses a color developer. For example, the method of the present invention can be applied to the photographic processing of color papers, color reversal papers, color direct positive photographic materials, color positive films, color negative films, color reversal films, etc., and in particular, is especially preferably applied to the photographic processing of color papers and color reversal papers.

The silver halide emulsions in the photographic light-sensitive materials to be processed by the method of the present invention may have any halogen compositions, for example, silver iodobromide, silver bromide, silver chlorobromide, silver chloride, etc. For example, in the case of rapid processing or processing with low replenishment for color papers, etc., a silver chlorobromide emulsion containing silver chloride in an amount of 60 mol % or more or a silver chloride emulsion is preferred, and in particular, the emulsion having a silver chloride content of from 80 to 100 mol % is most preferred. If a high sensitivity is specifically required, and the fog is required to be specifically lowered during the manufacture, storage and/or processing procedure of the photographic material, a silver chlorobromide emulsion containing silver bromide in an amount of 50 mol % or more or a silver bromide emulsion (which may contain 3 mol % or less silver iodide) is preferred, and in particular, the silver bromide content in the emulsion is more preferably 70 mol % or more. For color photographic materials for picture-taking, a silver iodobromide and a silver chloroiodobromide are preferred, in which the silver iodide content is preferably from 3 to 15 mol %.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of such grains having different phase structures.

The average grain size (the diameter of the grain is used when the grain is spherical or resembles spherical, the average value based on the project area using the edge length as the grain size is used when the grain is a cubic grain, or the diameter of the corresponding circle is used when the grain is a tabular grain) of the silver halide grains for use in the present invention is preferably from 0.1 μm to 2 μm, and more preferably from 0.15 μm to 1.5 μm. The grain size distribution of the silver halide emulsion for use in the present invention may be narrow or broad, but a so-called monodispersed silver halide emulsion wherein the value (variation coefficient) obtained by dividing the standard deviation in the grain distribution curve by the average grain size is within about 20%, and preferably within 15%, is preferably used in the present invention. Also, for satisfying the gradation required for the color photographic material, two or more kinds of monodisperse silver halide emulsions (preferably having the above-mentioned variation coefficient as the monodispersibility) can exist in an emulsion layer having substantially the same color sensitivity as a mixture thereof or exist in two or more emulsion layers, respectively, each having substantially the same color sensitivity. Furthermore, two or more kinds of polydisperse silver halide emulsions or a combination of a monodisperse emulsion and a polydispersed emulsion can be used in one emulsion layer as a mixture thereof, or in two or more layers, respectively.

The silver halide grains for use in the present invention may have a regular crystal form such as cubic, octahedral, rhombic dodecahedral or tetradecahedral or a combination thereof, or an irregular crystal form such as spherical, or further a composite form of these crystal forms. Also, a tabular grain silver halide emulsion can be used in the present invention. In particular, tabular grain silver halide emulsion wherein tabular silver halide grains having an aspect ratio (length/thickness) of 8 or more and preferably from 5/1 to 8/1, account for 50% more of the total projected area of the silver halide grains may be used. The silver halide emulsion for use in the present invention may be a mixture of these emulsions containing silver halide grains each having different crystal forms. Also, the silver halide grains may be of a surface latent image type capable of forming latent images mainly on the surfaces thereof or of an internal latent image type capable of forming latent images mainly in the inside thereof.

The photographic emulsions for use in the present invention can be prepared by the method described in *Research Disclosure,* Vol. 170, RD No. 17643, I, II, III (December, 1978).

The photographic emulsions are generally subjected to physical ripening, chemical ripening, and spectral sensitization, for use in the present invention. The additives to be used in the said steps of ripening and sensitization are described in *Research Disclosure,* Vol. 176, RD No. 17643 (December, 1978) and ibid. Vol. 187, RD No. 18716 (November, 1979), and the relevant parts are summarized in the following Table.

Known photographic additives which can be used in the present invention are also described in the said two *Research Disclosure* publications, and the relevant parts are also mentioned in the following Table.

| Additives | RD No. 17643 (Dec. 1978) | RD No. 18716 (Nov. 1979) |
|---|---|---|
| 1. Chemical Sensitizer | p. 23 | p. 648, right column |
| 2. Sensitivity Increasing Agents | — | p. 648, right column |
| 3. Spectral Sensitizer | pp. 23–24 | from p. 648, right column to p. 649, right column |
| 4. Super Color Sensitizer | pp. 23–24 | from p. 648, right column to p. 649, right column |
| 5. Brightening Agent | p. 24 | — |
| 6. Anti-foggant Stabilizer | pp. 24–25 | p. 649, right column |
| 7. Coupler | p. 25 | p. 649, right column |
| 8. Organiz Solvent | p. 25 | — |
| 9. Light Absorbent Filter Dye | pp. 25–26 | from p. 649, right column to p. 650, left column |
| 10. UV Absorbent | — | p. 650, left column |
| 11. Stain Inhibitor | p. 25, right-column | P. 650, from left to right column |
| 12. Color Image Stabilizer | p. 25 | — |
| 13. Hardener | p. 26 | p. 651, left column |
| 14. Binder | p. 26 | p. 651, left column |
| 15. Plasticizer, Lubricant | p. 27 | p. 650, right column |
| 16. Coating Assistant, Surfactant | pp. 26–27 | p. 650, right column |
| 17. Anti-static Agent | p. 27 | p. 650, right column |

Various kinds of color couplers can be used in the present invention. The.color coupler as referred to herein means a compound capable of forming a dye by coupling reaction with the oxidation product of an aromatic primary amine developing agent. Specific examples of useful color couplers include naphthol or phenol series compounds, pyrazolone or pyrazoloazole series compounds and open-chain or heterocyclic ketomethylene compounds. Examples of the cyan, magenta, and yellow couplers which can be used in the present invention are described in the patent publication as referred to in *Research Disclosure,* RD No. 17643 (December, 1978), VII-D and ibid., RD No. 18717 (November, 1979).

It is preferred that the couplers to be incorporated into the color photographic materials which are processed by the process of the present invention are non-diffusible due to having a ballast group or being polymerized. Also, the use of 2-equivalent color couplers substituted by a releasable group can reduce the amount of silver required for the color photographic materials as compared to 4-equivalent color couplers having a hydrogen atom at the coupling active group. Couplers giving colored dyes having a proper diffusibility, noncolor-forming couplers, DIR (development inhibitor releasing) couplers releasing a development inhibitor with coupling reaction, or DAR (development accelerator releasing) couplers releasing a development accelerator with coupling reaction can also be used in the present invention.

Examples of yellow couplers for use in the present invention include oil protect type acylacetamido series couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom releasing type yellow couplers described in Japanese Patent Publication No. 10739/80, U.S. Pat. Nos. 4,401,752, 4,326,024, *Research Disclosure,* RD No. 18053 (April, 1979), British Pat. No. 1,425,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilde couplers are excellent in coloring density.

Examples of magenta couplers for use in the present invention include oil protect type indazolone series or cyanoacetyl series couplers, and preferably 5-pyrazolone series magenta couplers and other pyrazoloazole series couplers such as pyrazoloazoles, etc. As the 5-pyrazolone series couplers, those substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896 and 3,936,015, etc. Also, as the releasable groups for the 2-equivalent 5-pyrazolone series couplers, the nitrogen atom-releasing groups described in U.S. Pat. No. 4,310,619, and the arylthio groups described in U.S Pat. No. 4,351,897 are preferred. Furthermore, the 5-pyrazolone series magenta couplers having a ballast group described in European Pat. No. 73,636 give high coloring density.

Examples of pyrazoloazole series couplers include the pyrazolobenzimidazoles described in U.S. Pat. No. 3,369,879, preferably the pyrazolo{5,1-c}{1,2,4}triazoles described in U.S. Pat. No. 3,725,067, the pyrazolotetrazoles described in *Research Disclosure,* RD No. 24220 (June, 1984), and the pyrazolopyrazoles described in *Research Disclosure,* RD No. 24230(June, 1984). The imidazo {1,2-b}pyrazoles described in European Pat. No. 119,741 are preferred because of the small yellow side-absorption of the colored dye and of the sufficient light-fastness thereof, and in particular, the pyrazolo {1,5-b}{1,2,4}triazoles described in European Pat. No. 119,860 are especially preferred.

Examples of cyan couplers for use in the present invention, include oil protect type naphthol series or phenol series couplers. Specific examples of the naphthol series couplers include the cyan couplers described in U.S. Pat. No. 2,474,293 and preferably the oxygen atom-releasing type 2-equivalent naphthol series couplers described in U.S. Pat. Nos. 4,052,212, 4,146,396, 4,228,233, and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and specific examples of these cyan couplers include the phenol series cyan couplers having an alkyl group of 2 or more carbon atoms at the meta-position of the phenol nucleus described in U.S. Pat. No. 3,772,002; the 2,5-diacylamino-substituted phenol series cyan couplers described in U.S. Pat. Nos. 2,772,162, 3,758,308, 4,126,396, 4,334,011, 4,327,173, West German Patent Application (OLD) No. 3,329,729, Japanese Patent Application (OPI) No. 166956/84, etc.; and the phenol series couplers having a phenylureido group at the 2-position thereof and an acylamino group at the 5-position thereof described in U.S. Pat. Nos. 3,446,622, 4,333,999, 4,451,559, and 4,427,767.

In the process of the present invention, at least one cyan coupler as represented by formula (C-I) is preferably used, whereby excellent photographic characteristics with less fog can be obtained.

The formula (C-I) is as follows, and is described in further detail hereunder.

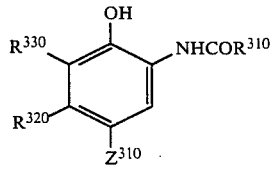

(C-I)

In formula (C-I), $R^{310}$ represents an alkyl group, a cycloalkyl group, an aryl group, an amino group or a heterocyclic group;

$R^{320}$ represents an acylamino group or an alkyl group having 2 or more carbon atoms;

$R^{330}$ represents a hydrogen atom, a halogen atom, an alkyl group or an alkoxy group; or $R^{330}$ may be bonded to $R^{320}$ to form a ring; $Z^{310}$ represents a hydrogen atom, a halogen atom or a group capable of being released by the reaction with the oxidation product of an aromatic primary amine color developing agent.

In formula (C-I), the alkyl group for $R^{310}$ has from 1 to 32 carbon atoms, and is, for example, a methyl group, a butyl group, a tridecyl group, a cyclohexyl group, allyl group, etc.; the aryl group is, for example, a phenyl group, a naphthyl group, etc.; and the heterocyclic group is, for example, a 2-pyridyl group, a 2-furyl group, etc.

When $R^{310}$ is an amino group, it is preferably an optionally substituted phenyl-substituted amino group.

$R^{310}$ may further be substituted by substituent(s) selected from an alkyl group; an aryl group; an alkyl- or aryl-oxy group (e.g., a methoxy group, a dodecyloxy group, a methoxyethoxy group, a phenyloxy group, a 2,4-di-tert-amylphenoxy group, a 3-tert-butyl-4-hydroxyphenyloxy group, a naphthyloxy group, etc.); a carboxyl group; an alkyl- or aryl-carbonyl group (e.g., an acetyl group, a tetradecanoyl group, a benzoyl group, etc.); an alkyl- or aryl-oxycarbonyl group (e.g., a methoxycarbonyl group, a phenoxcarbonyl group, etc.); an acyloxy group (e.g., an acetyl group, a benzoyloxy group, etc.); a sulfamoyl group (e.g., an N-ethylsulfamoyl group, an N-octadecylsulfamoyl group, etc.); a carbamoyl group (e.g., an N-ethylcarbamoyl group, an N-methyl-dodecylcarbamoyl group, etc.); a sulfonamido group (e.g., a methanesulfonamido group, a benzenesulfonamido group, etc.); an acylamino group (e.g., an acetylamino group, a benzamido group, an ethoxycarbonylamino group, a phenylaminocarbonylamino group, etc.); an imido group (e.g., a succinimido group, a hydantoinyl group, etc.); a sulfonyl group (e.g., a methanesulfonyl group, etc.); a hydroxyl group; a cyano group; a nitro group; and a halogen atom.

In formula (C-I), $Z^{310}$ represents a hydrogen atom or a coupling releasable group. Examples of the coupling releasable group are a halogen atom (e.g., a fluorine atom, a chlorine atom, a bromine atom, etc.); an alkoxy group (e.g., a dodecyloxy group, a methoxycarvamoylmethoxy group, a carboxypropyloxy group, a methylsulfonylethoxy group, etc.); an aryloxy group (e.g., a 4-chlorophenoxy group, a 4-methoxyphenoxy group, etc.), an acyloxy group (e.g., an acetoxy group, a tetradecanoyloxy group, a benzoyloxy group, etc.); a sulfonyloxy group (e.g., a methanesulfonyloxy group, a toluenesulfonyloxy group, etc.); an amido group (e.g., a dichloroacetylamino group, a methanesulfonylamino group, a toluenesulfonylamino group, etc.); an alkoxycarbonyloxy group (e.g., an ethoxycarbonyloxy group, a benzyloxycarbonyloxy group, etc.); an aryloxycarbonyloxy group (e.g., a phenoxycarbonyloxy group, etc.); an aliphatic or aromatic thio group (e.g., a phenylthio group, a tetrazolylthio group, etc.); an imido group (e.g., a succinimido group, a hydantoinyl group, etc.); an N-heterocyclic group (e.g., a 1-pyrazolyl group, a 1-benztriazolyl group, etc.); an aromatic azo group (e.g., a phenylazo group, etc.), etc. These releasable groups can contain a photographically useful group.

The compound of formula (C-I) may form a dimer or a polymer at the position of $R^{310}$ or $R^{320}$.

Specific examples of the cyan couplers of the above-mentioned formula (C-I) are described below, but such is not intended to restrict the scope of the present invention.

(C-1)

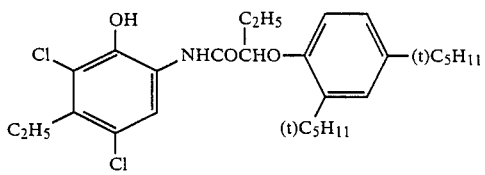

(C-2)

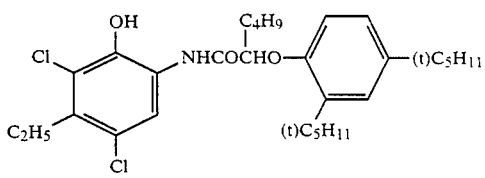

(C-3)

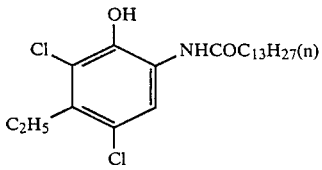

(C-4)

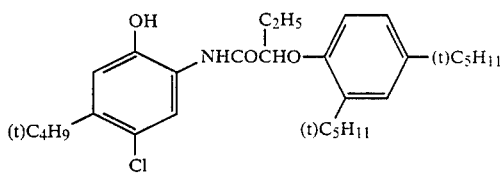

(C-5)

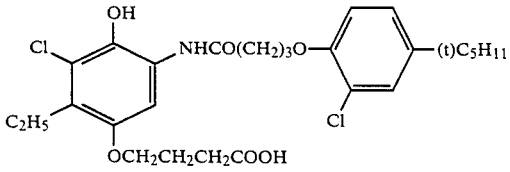

(C-6)

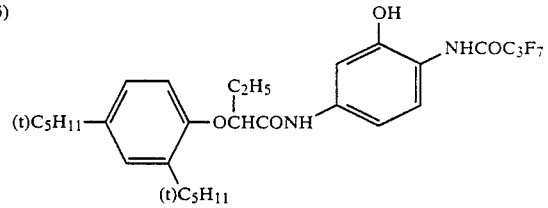

(C-7)

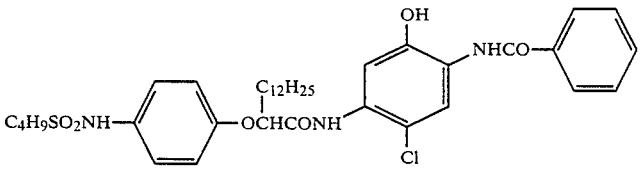

(C-8)

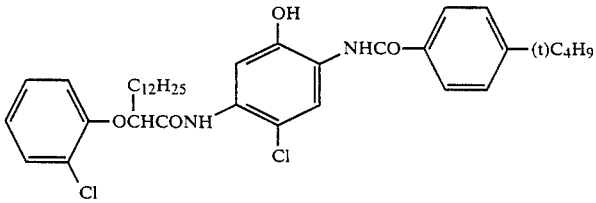

-continued
(C-9)
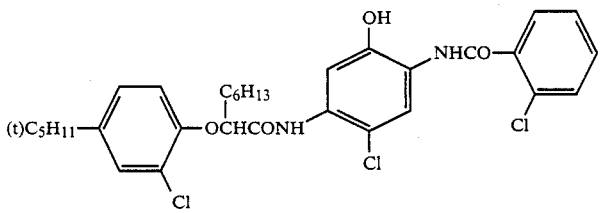
(C-10)
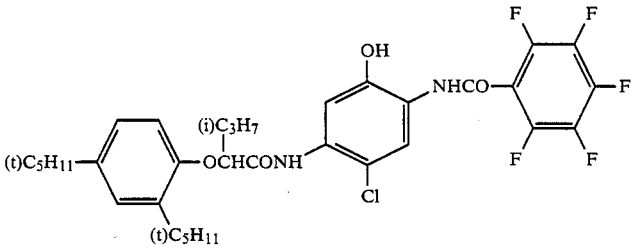
(C-11)
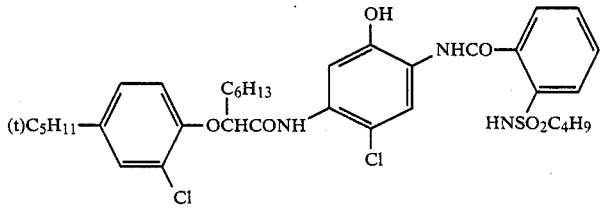
(C-12)
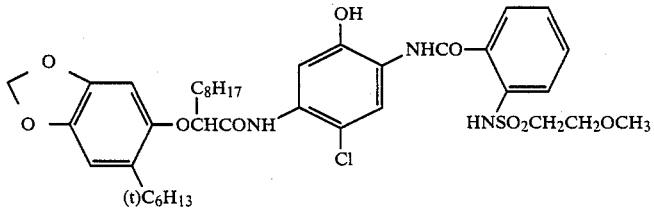
(C-13)
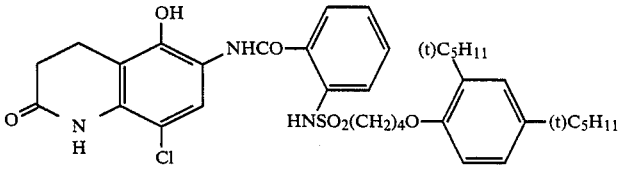
(C-15)
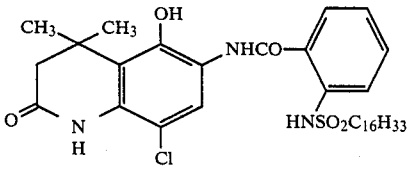
(C-14)
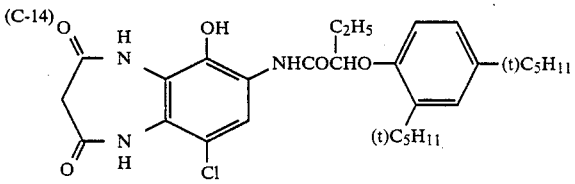
(C-16)
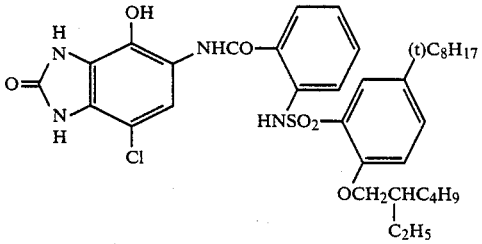

-continued
(C-17)
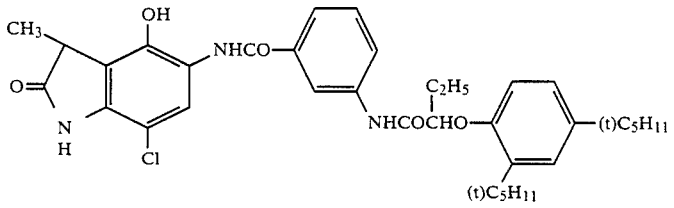
(C-18)
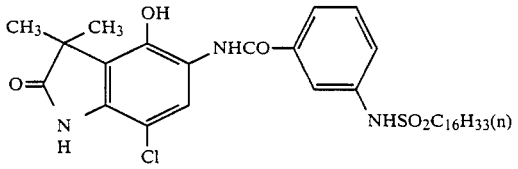
(C-19)
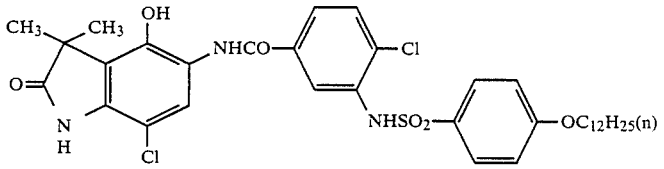
(C-20)
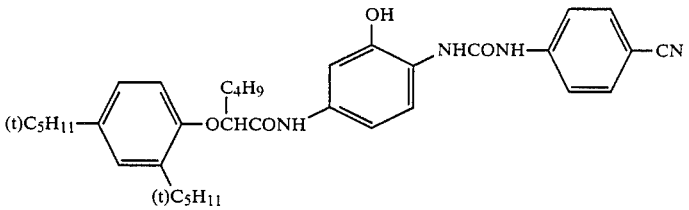
(C-21)
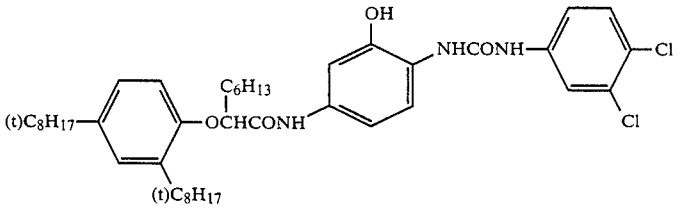
(C-22)
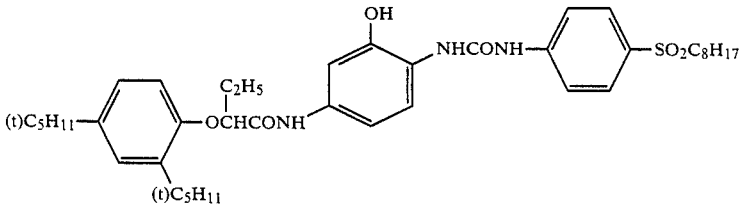
(C-23)
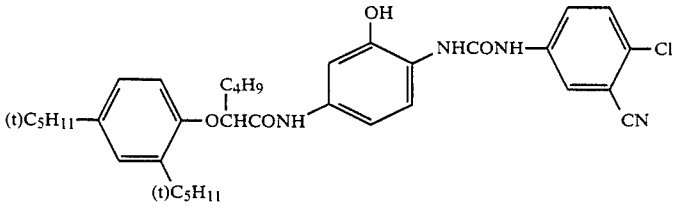

-continued (C-24)

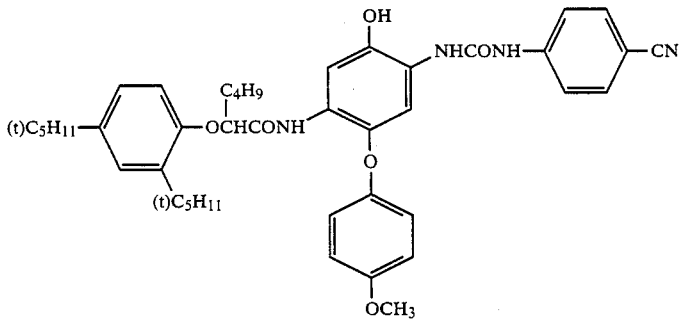

(C-25)

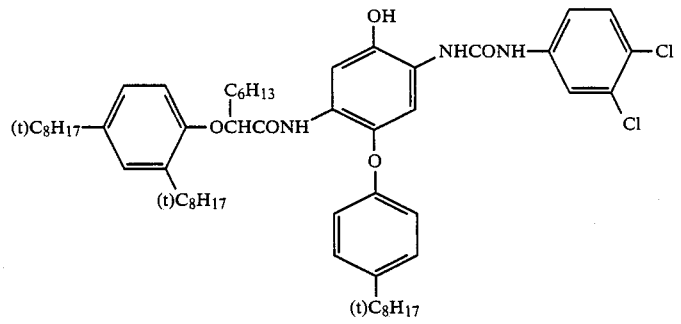

(C-26)

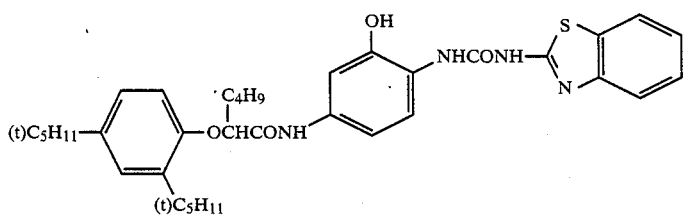

The cyan couplers of the above-mentioned formula (C-I) can be produced, e.g., in accordance with the descriptions of Japanese Patent Application (OPI) No. 166956/84 and Japanese Patent Publication No. 11572/74, etc.

In the present invention, by using couplers giving colored dyes having a proper diffusibility together with the aforesaid color couplers, the graininess of color images formed can be improved. Specific examples of couplers giving such diffusible dyes are described in U.S. Pat. No. 4,366,237 and British Pat. No. 2,125,570, and specific examples of yellow, magenta and cyan couplers of this type are described in European Pat. No. 96,570 and West German Patent Application (OLS) No. 3,234,533.

The dye-forming couplers and the above-described specific couplers for use in the present invention may form dimers or polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used in two or more photographic layers for meeting desired characteristics.

The couplers for use in the present invention can be incorporated into the photographic light-sensitive materials by means of various known dispersion methods. For instance, an oil-in-water dispersion method can be mentioned as one example, and examples of high boiling point organic solvents which can be used in the oil-in-water dispersion method are described, e.g., in U.S. Pat. No. 2,322,027, etc. Another example is a latex dispersion method, and the procedure, effect, and examples of latexes to be used for impregnation are described in U.S. Pat. No. 4,199,363, West German Patent Application (OLS) Nos. 2,541,274 and 2,541,230, etc.

The standard amount of the color coupler to be incorporated is in the range of from 0.001 to 1 mol per mol of the light-sensitive silver halide in the silver halide emulsion and the preferred amount is from 0.01 to 0.5 mol for yellow coupler, from 0.003 to 0.3 mol for magenta coupler and from 0.002 to 0.3 mol for cyan coupler.

The photographic light-sensitive material for use in the present invention is coated on a conventional flexible support such as plastic films (e.g., cellulose nitrate, cellulose acetate, polyethylene terephthalate, etc.) or paper or a conventional rigid support such as glass, etc. The details of the supports and the coating means are described in *Research Disclosure,* RD No. 17643, XV (page 27) and XVII (page 28) (December, 1978).

In the present invention, a reflective support is preferably used.

The "reflective support" has a high reflectivity for clearly viewing the dye images formed in silver halide emulsion layers of the color photographic material, and this includes a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above.

The following examples are intended to illustrate the present invention but not to limit it in any way. Unless otherwise indicated, all percents, ratio and like are by weight.

EXAMPLE 1

A color developer having the following composition was prepared.

Color Developer:

| | |
|---|---|
| Compound (A) (compound of the present invention) | See Table 1 |
| Compound (B) (hydroxylamine series compound) | See Table 1 |
| Sodium Sulfate | 0.2 g |
| Potassium Carbonate | 30 g |
| EDTA.2Na | 1 g |
| Sodium Chloride | 1.5 g |
| 4-Amino-3-methyl-N—ethyl-N—{β-(methanesulfonamido)ethyl}-aniline.sulfate | 5.0 g |
| Brightening Agent (UVITEX-CK, 4,4'-diaminostylbene series brightening agent manufactured by Ciba Geigy Co.) | 3.0 g |
| Water to make | 1000 ml |
| pH | 10.05 |

Samples (Nos. 1-1 to 1-20) of the thus prepared color developer were put in test tubes each with an opening mouth ratio (opening area/sample area) of 0.05 $cm^{-1}$ and kept at 35° C. for 4 weeks. After 4 weeks, the decrement by evaporation was compensated for by addition of distilled water to the samples, and then the retention percentage of the aromatic primary amine color developing agent in the developer solution was measured and calculated by liquid chromatography. The results obtained are shown in Table 1 below.

The results of Table 1 demonstrate that the retention percentage of the developing agent could be somewhat improved by the addition of the compound of triethanolamine, polyethyleneimine or sodium sulfite (sample Nos. 1-3, 1-4 and 1-5), as opposed to the single use of the hydroxylamine or diethylhydroxylamine (sample Nos. 1-1 and 1-2), but such improvement could not be said sufficient.

However, the results of the sample Nos. 6 to 17 in Table 1 clearly demonstrate that the retention percentage of the developing agent was extremely improved by the use of the compound of formula (I), so that the preservation of the color developer was improved.

TABLE 1

| Sample No. | Compound (A) (*1) 0.03 mol/l | Compound (B) (*2) 0.04 mol/l | | Retention Percentage of Developing Agent (*3) (%) |
|---|---|---|---|---|
| 1-1 | — | II-16 | Comparison | 7 |
| 1-2 | — | II-15 | " | 15 |
| 1-3 | Triethanolamine | II-16 | " | 75 |
| 1-4 | Polyethyleneimine (*4) | " | " | 63 |
| 1-5 | $Na_2SO_3$ | " | " | 75 |
| 1-6 | I-1 | II-3 | Present Invention | 85 |
| 1-7 | " | II-15 | " | 86 |
| 1-8 | " | II-16 | " | 86 |
| 1-9 | I-3 | II-3 | " | 87 |
| 1-10 | " | II-15 | " | 87 |
| 1-11 | " | II-16 | " | 88 |
| 1-12 | I-11 | II-3 | " | 89 |
| 1-13 | " | II-15 | " | 88 |
| 1-14 | " | II-16 | " | 89 |
| 1-15 | " | N,N—diethylhydrazine | " | 91 |
| 1-16 | " | Glucose | " | 87 |
| 1-17 | " | Dihydroxyacetone | " | 88 |
| 1-18 | — | N,N—diethylhydrazine | Comparison | 30 |
| 1-19 | — | Glucose | " | about 0 |
| 1-20 | — | Dihydroxyacetone | " | 11 |

(*1) Number of the compound described hereinbefore.
(*2) Number of the compound described hereinbefore.
(*3) Retention percentage of developing agent = $\frac{\text{Concentration of developing agent remained}}{0.5\ \text{g/liter}} \times 100$
(*4) $\text{-}(CH_2CH_2NH)_n\text{-}$ (n = 500 to 2000).

EXAMPLE 2

A multilayer color photographic paper was prepared by forming the layers having the compositions shown below on a paper support, both surfaces of which were coated with polyethylene. The coating compositions for the layers were prepared as follows.

Coating Composition for First Layer:

27.2 ml of ethyl acetate and 7.7 ml (8.0 g) of high boiling point solvent (Solv-1) were added to 19.1 g of yellow coupler (ExY-1) and 4.4 g of color image stabilizer (Cpd-1) and dissolved, and the resulting solution was dispersed by emulsification in 185 ml of an aqueous 10 wt. % gelatin solution containing 8 ml of a 10 wt. % sodium dodecylbenzenesulfonate. The emulsified dispersion and Emulsion (EM7) and Emulsion (EM8) were blended and dissolved and the gelatin concentration was adjusted as shown below to provide the coating composition for the first layer. Coating compositions for the second layer to the seventh layer were also prepared by the same manner as in the first layer. As a gelatin hardening agent for each layer, 1-hydroxy-3,5-dichloro-s-triazine sodium salt was used. As a tackifier was used Compound (Cpd-2).

The compositions of the layers were as follows. The number means the amount coated (g/$m^2$). The amount of the silver halide emulsion coated means the amount of silver therein.

Support:

Polyethylene-coated Paper (i.e., Polyethylene-laminated paper), containing a white pigment ($TiO_2$) and a bluish dye in the polyethylene coat for the first layer.

| | |
|---|---|
| **First Layer: Blue-sensitive Emulsion Layer** | |
| Monodisperse Silver Chlorobromide Emulsion (EM7) (spectrally sensitized with Sensitizing Dye (ExS-1)) | 0.15 |
| Monodisperse Silver Chlorobromide Emulsion (EM8) (spectrally sensitized with Sensitizing Dye (ExS-1)) | 0.15 |
| Gelatin | 1.86 |
| Yellow Coupler (ExY-1) | 0.82 |
| Color Image Stabilizer (Cpd-2) | 0.19 |
| Solvent (Solv-1) | 0.35 |
| **Second Layer: Color Mixing Preventing Layer** | |
| Gelatin | 0.99 |
| Color Mixing Preventing Agent (Cpd-3) | 0.08 |
| **Third Layer: Green-sensitive Emulsion Layer** | |
| Monodisperse Silver Chlorobromide Emulsion (EM9) (spectrally sensitized with Sensitizing Dyes (ExS-2, 3)) | 0.12 |
| Monodisperse Silver Chlorobromide Emulsion (EM10) (spectrally sensitized with Sensitizing Dyes (ExS-2, 3) | 0.24 |
| Gelatin | 1.24 |
| Magenta Coupler (ExM-1) | 0.39 |
| Color Image Stabilizer (Cpd-4) | 0.25 |
| Color Image Stabilizer (Cpd-5) | 0.12 |
| Solvent (Solv-2) | 0.25 |
| **Fourth Layer: Ultraviolet Absorbing Layer** | |
| Gelatin | 1.60 |
| Ultraviolet Absorbent (Ratio of Cpd-6/Cpd-7/Cpd-8 is 3/2/6, by weight) | 0.70 |
| Color Mixing Preventing Agent (Cpd-9) | 0.05 |
| Solvent (Solv-3) | 0.42 |
| **Fifth Layer: Red-sensitive Emulsion Layer** | |
| Monodisperse Silver Chlorobromide Emulsion (EM11) (spectrally sensitized with Sensitizing Dyes (ExS-4, 5)) | 0.77 |
| Monodisperse Silver Chlorobromide Emulsion (EM12) (spectrally sensitized with Sensitizing Dyes (ExS-4, 5)) | 0.16 |
| Gelatin | 0.92 |
| Cyan Coupler (ExC-1) | 1.46 |

-continued

| | |
|---|---|
| Cyan Coupler (ExC-2) | 1.84 |
| Color Image Stabilizer (Ratio of Cpd-7/Cpd-8/Cpd-10 is 3/4/2, by weight) | 0.17 |
| Dispersing Polymer (Cpd-11) | 0.14 |
| Solvent (Solv-1) | 0.20 |
| **Sixth Layer: Ultraviolet Absorbing Layer** | |
| Gelatin | 0.54 |
| Ultraviolet Absorbent (Ratio of Cpd-6/Cpd-8/Cpd-10 is 1/5/3, by weight) | 0.21 |
| Solvent (Solv-4) | 0.08 |
| **Seventh Layer: Protective Layer** | |
| Gelatin | 1.33 |
| Acryl-modified Polyvinyl Alcohol Copolymer (modification degree: 17%) | 0.17 |
| Liquid Paraffin | 0.03 |

As an anti-irradiation dye were used Compounds (Cpd-12, Cpd-13).

In addition, Aklanol XC (manufactured by Du Pont Ltd), sodium alkylbenzenesulfonate, succinic acid ester and Magefacx F-120 (manufactured by Dai-Nippon Ink & Chemicals, Inc.) were used as an emulsification and dispersing agent and a coating assistant agent in each layer. As a stabilizer for silver halides, Compounds (Cpd-14, 15) were used.

The details of the emulsions used are as follows.

| Emulsion | Grain Shape | Grain Size (μ) | Br Content (mole %) | Variation Coefficient(*) |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

(*) $\frac{\text{Standard Deviation}}{\text{Average Grain Size}}$ (This means the grain size distribution.)

The structural formulae of the compounds used are as follows.

ExY-1

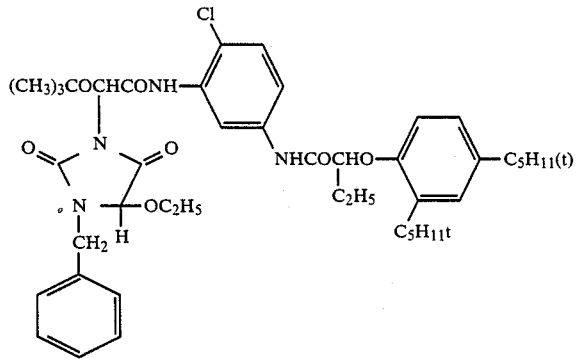

-continued
ExM-1
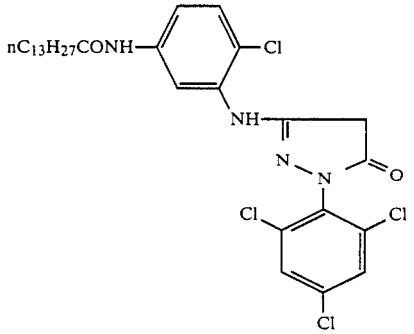
ExC-1
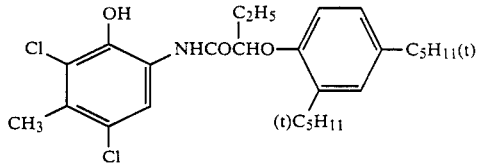
ExC-2
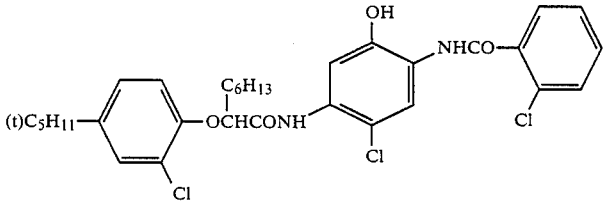
ExS-1
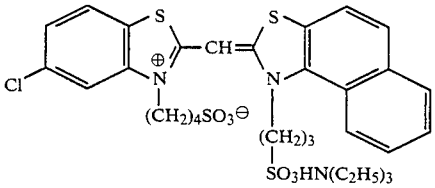
ExS-2
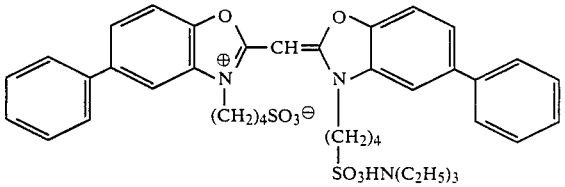
ExS-3
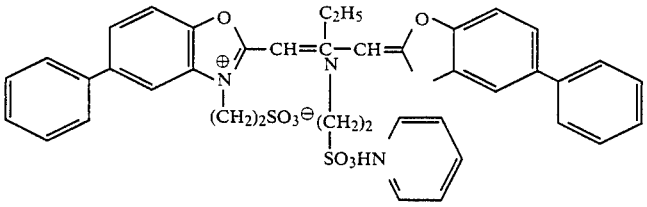
ExS-4
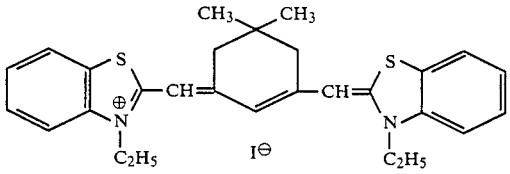
ExS-5
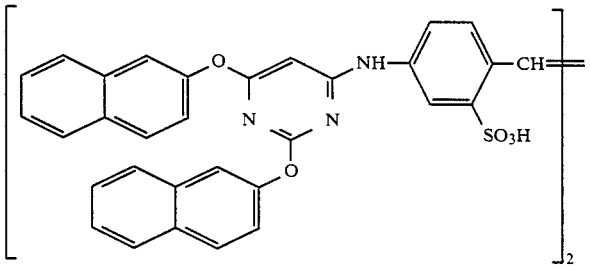

-continued
Cpd-1
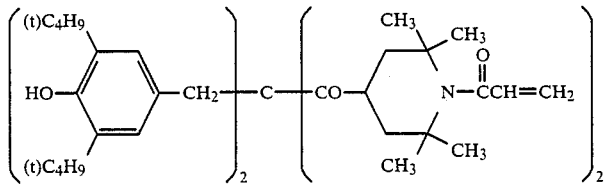
Cpd-2
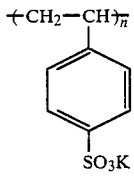
Cpd-3
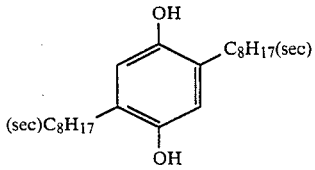
Cpd-4
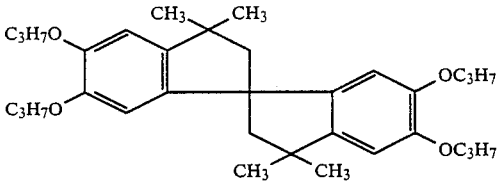
Cpd-5
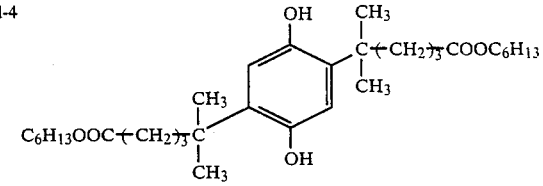
Cpd-6
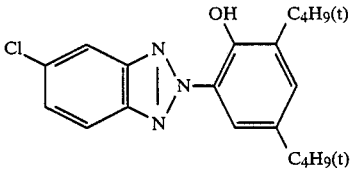
Cpd-7
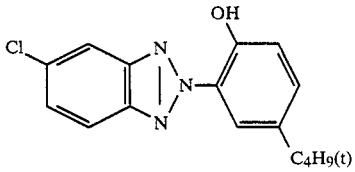
Cpd-8
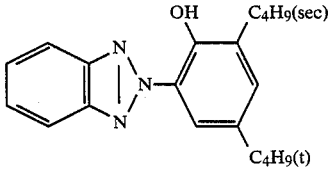
Cpd-9
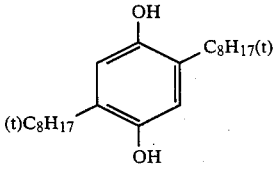
Cpd-10
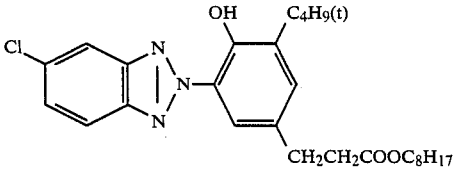
Cpd-11
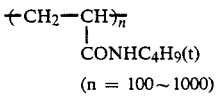
(n = 100 ~ 1000)
Cpd-12
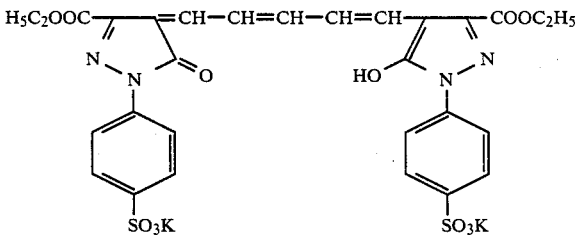
Cpd-13
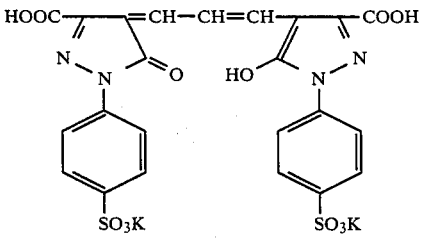

-continued

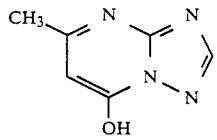

Cpd-14

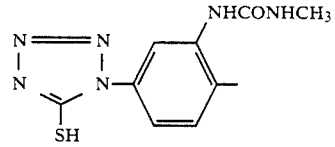

Cpd-15

| | | | |
|---|---|---|---|
| Dibutyl Phthalate | Solv-1 | Trioctyl Phosphate | Solv-2 |
| Trinonyl Phosphate | Solv-3 | Tricresyl Phosphate | Solv-4 |

The color photographic paper thus prepared was processed with a color developer in accordance with the following processing procedure, wherein the composition of the color developer was varied.

| Processing Step | Temperature | Time |
|---|---|---|
| Color Development | 35° C. | 45 sec |
| Bleach-fixing | 35° C. | 45 sec |
| Rinsing (1) | 35° C. | 20 sec |
| Rinsing (2) | 35° C. | 20 sec |
| Rinsing (3) | 35° C. | 20 sec |
| Rinsing (4) | 35° C. | 20 sec |
| Drying | 70 to 80° C. | 60 sec |

The rinsing step was carried out by a four-tank countercurrent rinsing system from the rinsing bath (4) to the rinsing bath (1). The processing solutions used in the respective steps were as follows.

Color Developer:

| | |
|---|---|
| Additive (C) (hydroxylamine, etc.) | See Table 2 |
| Additive (D) (compound of the invention) | See Table 2 |
| Benzyl Alcohol | See Table 2 |
| Diethylene Glycol | See Table 2 |
| Sodium Sulfite | 0.2 g |
| Potassium Carbonate | 30 g |
| Ethylenediamine-N,N,N',N'—tetramethylene-phosphonic Acid | 3 g |
| Sodium Chloride | 1.5 g |
| Color Developing Agent (See Table 2) | 0.01 mol |
| Brightening Agent (UVITEX CK, manufactured by Ciba-Geigy Co.) | 30 g |
| Water to make | 1000 ml |
| pH | 10.05 |

Bleach-fixing Solution:

| | |
|---|---|
| EDTA Fe(III)$NH_4$.2$H_2O$ | 60 g |
| EDTA.2Na.2$H_2O$ | 4 g |
| Ammonium Thiosulfate (70 wt. %) | 120 ml |
| Sodium Sulfite | 16 g |
| Ammonium Bromide | 30 g |

-continued

| | |
|---|---|
| Glacial Acetic Acid | 7 g |
| Water to make | 1000 ml |
| pH | 5.5 |

Rinsing Solution:

Ion-exchanged Water (Calcium and magnesium contents each were 3 ppm or less.)

On the other hand, a part of the abovementioned color developer was put in an one-liter beaker and allowed to stand at 35° C. for 21 days in an opened system. The thus aged developer was also used for carrying out the above-mentioned process.

The test where the color developer as stored for 21 days (aged solution) was used was designated as an aged solution test; and the test where the color developer before storage (fresh solution) was used was designated as a fresh solution test.

The results of the photographic properties obtained in the fresh solution test and the aged solution test are shown in Table 2 below.

The photographic properties were represented by the value Dmin and the gradation of the magenta density in each sample.

The value Dmin means the minimum density, and the gradation was represented by the variation of the density from the point of density 0.5 to the density point in the higher exposure side by 0.3 of log E.

The results of Table 2 demonstrate that the value Dmin and the gradation noticeably varied in the sample Nos. 2-1 to 2-4 with the lapse of time and the contrast increased thereby, while the variation of the value Dmin and the gradation was small in the sample Nos. 2-5 to 2-18 even with the lapse of time, and the stability of the photographic properties was extremely improved. In addition, the variation of the value Dmin and the gradation was smallest in the sample Nos. 2-8, 2-13 and 2-17 among the sample Nos. 2-5 to 2-8 and 2-10 to 2-17, and the compound (d) was most preferred among the color developing agents.

TABLE 2

| Sample No. | Color Development Agent (*) | Benzyl Alcohol, Diethylene Glycol (ml/ml | Additive (C) (0.04 mol) | Additive (D) (0.03 mol) | Developer | Fresh Solution Dmin | Fresh Solution Gradation | Aged Solution Dmin | Aged Solution Gradation |
|---|---|---|---|---|---|---|---|---|---|
| 2-1 | (d) | 15/10 | II-15 | Triethanolamine | Comparison | 0.13 | 0.75 | 0.20 | 0.84 |
| 2-2 | (d) | — | " | " | " | 0.12 | 0.70 | 0.18 | 0.82 |
| 2-3 | (d) | — | " | Polyethyleneimine | " | 0.12 | 0.70 | 0.18 | 0.80 |
| 2-4 | (d) | — | II-16 | Triethanolamine | " | 0.12 | 0.47 | 0.20 | 0.51 |
| 2-5 | (a) | — | II-15 | I-1 | Present Invention | 0.12 | 0.63 | 0.14 | 0.76 |
| 2-6 | (b) | — | " | " | " | 0.12 | 0.72 | 0.15 | 0.75 |
| 2-7 | (c) | — | " | " | " | 0.12 | 0.72 | 0.14 | 0.76 |
| 2-8 | (d) | — | " | " | " | 0.12 | 0.72 | 0.12 | 0.73 |
| 2-9 | (d) | 15/10 | " | " | " | 0.13 | 0.76 | 0.16 | 0.80 |
| 2-10 | (a) | — | " | I-11 | " | 0.12 | 0.72 | 0.16 | 0.78 |
| 2-11 | (b) | — | " | " | " | 0.12 | 0.73 | 0.16 | 0.78 |
| 2-12 | (c) | — | " | " | " | 0.12 | 0.73 | 0.15 | 0.78 |
| 2-13 | (d) | — | " | " | " | 0.12 | 0.73 | 0.12 | 0.74 |
| 2-14 | (a) | — | II-3 | " | " | 0.12 | 0.74 | 0.15 | 0.80 |

TABLE 2-continued

| Sample No. | Color Development Agent (*) | Benzyl Alcohol, Diethylene Glycol (ml/ml | Additive (C) (0.04 mol) | Additive (D) (0.03 mol) | Developer | Fresh Solution Dmin | Fresh Solution Gradation | Aged Solution Dmin | Aged Solution Gradation |
|---|---|---|---|---|---|---|---|---|---|
| 2-15 | (b) | — | " | " | " | 0.12 | 0.74 | 0.15 | 0.78 |
| 2-16 | (c) | — | " | " | " | 0.12 | 0.74 | 0.15 | 0.78 |
| 2-17 | (d) | — | " | " | " | 0.12 | 0.74 | 0.12 | 0.75 |
| 2-18 | (d) | — | Glucose | " | " | 0.12 | 0.75 | 0.13 | 0.77 |

(*) Color developing agents (a) to (b) are the following compounds.

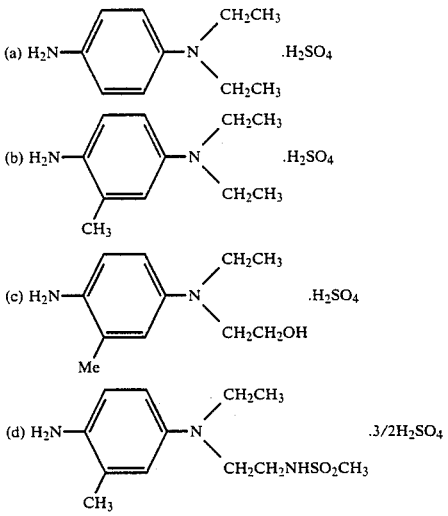

EXAMPLE 3

A photographic paper sample was prepared by forming the first layer (lowermost layer) to the seventh layer (uppermost layer), which are shown below, in order on a paper support both surfaces of which were coated with polyethylene and were processed by corona-discharge treatment. The coating compositions for the layers were prepared as mentioned below. The structural formulae of the couplers, color image stabilizers, etc. used in the coating compositions are described hereunder.

The coating composition for the first layer was prepared as follows. A mixture formed by adding 600 ml of ethyl acetate as an auxiliary solvent to 200 g of an yellow coupler, 93.3 g of an anti-fading agent, 10 g of high boiling point solvent (p) and 5 g of Solvent (g) was heated at 60° C. and dissolved, and then the resulting solution was blended with 3300 ml of an aqueous 5 wt. % gelatin solution containing 330 ml of an aqueous 5 wt. % solution of Alkanol B (alkylnaphthalene sulfonate trade name, manufactured by Du Point Ltd.). Next, this solution was emulsified with a colloid mill to provide a coupler dispersion. The ethyl acetate was evaporated out under reduced pressure from the dispersion, and the dispersion was added to 1400 g of an emulsion (containing 96.7 g of silver and 170 g of gelatin) to which a sensitizing dye for blue-sensitive emulsion layer and 1-methyl-2-mercapto-5-acetylamino-1,3,4-triazole had been added, and then 2600 g of an aqueous 10 wt. % gelatin solution was further added thereto, to provide the coating solution for the first layer. In the same manner as the preparation of the coating solution for the first layer as described above, the coating solutions for the second to seventh layers were also prepared, to have the compositions as described below.

As the cyan coupler in the fifth layer, the cyan coupler shown in Table 3 below was used, and thus various kinds of photographic paper samples were prepared.

The compositions of the layers were as follows:

Support:

Paper support, both surfaces of which were coated with polyethylene.

| | |
|---|---|
| **First Layer: Blue-sensitive Emulsion Layer** | |
| Silver Chlorobromide Emulsion (silver bromide content: 1 mol %) | 290 mg/m$^2$ as Ag |
| Yellow Coupler | 600 mg/m$^2$ |
| Anti-fading Agent (r) | 280 mg/m$^2$ |
| Solvent (p) | 30 mg/m$^2$ |
| Solvent (q) | 15 mg/m$^2$ |
| Gelatin | 1800 mg/m$^2$ |
| **Second Layer: Color Mixing Preventing Layer** | |
| Silver Bromide Emulsion (primitive emulsion, grain size: 0.05 μm) | 10 mg/m$^2$ as Ag |
| Color Mixing Preventing Agent (s) | 55 mg/m$^2$ |
| Solvent (p) | 30 mg/m$^2$ |
| Solvent (q) | 15 mg/m$^2$ |
| Gelatin | 800 mg/m$^2$ |
| **Third Layer: Green-sensitive Emulsion Layer** | |
| Silver Chlorobromide Emulsion (silver bromide content: 0.5 mol %) | 305 mg/m$^2$ as Ag |
| Magenta Coupler | 670 mg/m$^2$ |
| Anti-fading Agent (t) | 150 mg/m$^2$ |
| Anti-fading Agent (u) | 10 mg/m$^2$ |
| Solvent (p) | 200 mg/m$^2$ |
| Solvent (q) | 10 mg/m$^2$ |
| Gelatin | 1400 mg/m$^2$ |
| **Fourth Layer: Color Mixing Preventing Layer** | |
| Color Mixing Preventing Agent (s) | 65 mg/m$^2$ |
| Ultraviolet Absorbent (n) | 450 mg/m$^2$ |
| Ultraviolet Absorbent (o) | 230 mg/m$^2$ |
| Solvent (p) | 50 mg/m$^2$ |
| Solvent (q) | 50 mg/m$^2$ |
| Gelatin | 1700 mg/m$^2$ |
| **Fifth Layer: Red-sensitive Emulsion Layer** | |
| Silver Chlorobromide emulsion (silver bromide content: 1 mol %) | 210 mg/m$^2$ as Ag |

-continued

| | |
|---|---|
| Cyan Coupler (See Table 3) | $5 \times 10^{-4}$ mol/m$^2$ |
| Color Mixing Preventing Agent (r) | 250 mg/m$^2$ |
| Solvent (p) | 160 mg/m$^2$ |
| Solvent (q) | 100 mg/m$^2$ |
| Gelatin | 1800 mg/m$^2$ |
| Sixth Layer: Ultraviolet Absorbing Layer | |
| Ultraviolet Absorbent (n) | 260 mg/m$^2$ |
| Ultraviolet Absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Seventh Layer: Protective Layer | |
| Gelatin | 600 mg/m$^2$ |

The compounds used above are as follows:

(n): 2-(2-Hydroxy-3,5-di-tert-amylphenyl)benzotriazole (o): 2-(2-Hydroxy-3,5-di-tert-butylphenyl)benzotriazole (p): Di(2-ethylhexyl) phthalate (q): Dibutyl phthalate (r): 2,5-Di-tert-amylphenyl-3,5-di-tert-butylhydroxybenzoate (s): 2,5-Di-tert-octylhydroquinone (t) : 1,4-Di-tert-amyl-2,5-dioctyloxybenzene (u) : 2,2'-Methylenebis(4-methyl-6-tert-butylphenol)

The following sensitizing dyes were used for the respective emulsion layers.

Blue-sensitive emulsion layer:

Anhydro-5-methoxy-5'-methyl-3,3'-disulfopropylselenacyanine hydroxide

Green-sensitive emulsion layer:

Anhydro-9-ethyl-5,5'-diphenyl-3,3'-disulfoethyloxacarbocyanine hydroxide

Red-sensitive emulsion layer:

3,3'-Diethyl-5-methoxy-9,9'-(2,2-dimethyl-1,3-propano)thiadicarbocyanine iodide

As the stabilizer for each layer was used 1-methyl-2-mercapto-5-acetylamino-1,3,4-triazole.

The following compounds were used as the anti-irradiation dye.

4-(3-Carboxy-5-hydroxy-4-(3-(3-carboxy-5-oxo-1-(4-sulfonatophenyl)-2-pyrazolin-4-ylidene)-1-propenyl)-1-pyrazolyl)benzenesulfonate dipotqssium salt.

N,N'-(4,8-Dihydroxy-9,10-dioxo-3,7-disulfonatoanthracene-1,5-diyl)bis(aminomethanesulfonato) tetrasodium salt As the hardener, 1,2-bis(vinylsulfonyl)ethane was used.

The couplers used were as follows:

Yellow Coupler:

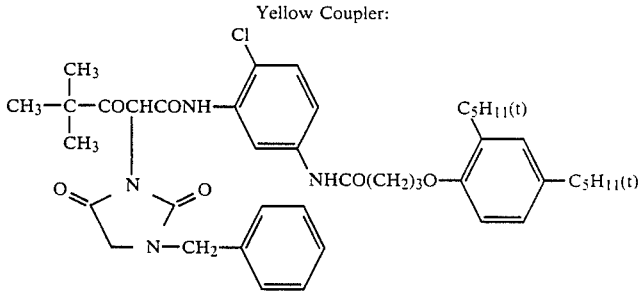

Magenta Coupler:

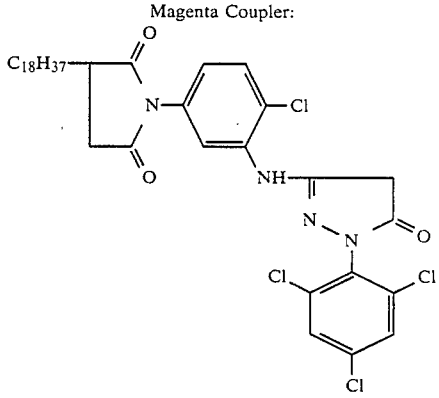

Cyan Coupler:
See Table 3.

The multilayer color photographic papers thus prepared were, after wedgewise exposed, processed in accordance with the following processing procedure.

| Processing Step | Time | Temperature |
|---|---|---|
| Color Development | 3 min 30 sec | 33° C. |
| Bleach-Fixing | 1 min 30 sec | 33° C. |
| Rinsing (3 tank-cascade) | 2 min | 30° C. |
| Drying | 1 min | 80° C. |

The processing solutions used in the respective processing steps were as follows.

Color Developer:

| | |
|---|---|
| Water | 800 ml |
| Sodium Sulfite | See Table 3 |
| N,N'—bis(2-hydroxybenzyl)-ethylenediamine-N,N'—diacetic Acid | 0.1 |
| Nitrilo-N,N,N—trimethylene-phosphonic Acid (40 wt. %) | 1.0 g |
| Potassium Bromide | 1.0 g |

-continued

| | |
|---|---|
| Additives (C), (D) | See Table 3 |
| Potassium Carbonate | 30 g |
| N—ethyl-N—(β-methanesulfonamido-ethyl)-3-methyl-4-aminoaniline.sulfate | 5.5 g |
| Brightening Agent (WHITEX-4,4,4'-diaminostylbene series brightening agent manufactured by Sumitomo Chemical Co., Ltd.) | 1.0 g |
| Water to make | 1000 ml |
| PH (the PH was adjusted by KOH) | pH 10.10 |

Bleach-fixing Solution:

| | |
|---|---|
| Ammonium Thiosulfate (70 wt. %) | 150 ml |
| Sodium Sulfite | 15 g |
| Ammonium Ethylenediamine-tetraacetic Acid/Iron(III) | 60 g |
| Ethylenediamine-tetraacetic Acid | 10 g |
| Brightening Agent (WHITEX-4,4,4'-diaminostylbene series brightening agent manufactured by Sumitomo Chemical Co., Ltd.) | 1.0 g |
| 2-Mercapto-5-amino-3,4-thiadiazole | 1.0 g |
| Water to make | 1000 ml |
| PH (the pH was adjusted by aqueous ammonia) | pH 7.0 |

Rinsing Solution:

| | |
|---|---|
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth Chloride (40 wt. %) | 0.5 g |
| Nitrilo-N,N,N—trimethylenephosphonic Acid (40 wt. %) | 1.0 g |

-continued

| | |
|---|---|
| 1-Hydroxyethylidene-1,1-diphosphonic Acid (60 wt. %) | 2.5 g |
| Brightening Agent (WHITEX-4,4,4'-diaminostylbene series brightening agent manufactured by Sumitomo Chemical Co., Ltd.) | 1.0 g |
| Aqueous Ammonia (26 wt. %) | 2.0 ml |
| Water to make | 1000 ml |
| pH (the pH was adjusted by KOH) | pH 7.5 |

In the same manner as Example 2, a part of the above-mentioned color developer was aged for 21 days. Using the fresh solution and the aged solution, the photographic paper samples were processed, and the value Dmin and the gradation of the cyan density were measured in every sample.

The increment of the value of Dmin and the gradation obtained by the processing with the aged solution, as compared to those obtained by the processing with the corresponding fresh solution, was calculated and shown in Table 3 below.

The results of Table 3 demonstrate that the variation of the value of Dmin and the gradation was small in the sample Nos. 3-4 to 3-18, even when the 21 day-aged developer was used, as opposed to the samples Nos. 3-1 to 3-3, and thus, it is noted that the photographic properties of the sample Nos. 3-4 to 3-18 were extremely stabilized. In particular, the preservation of the developer was extremely high when the Cyan Coupler (C-9) or (C-1) was used (sample Nos. 3-6, 3-7, 3-10, 3-11, 3-13, 3-15, 3-17, and 3-18), or when the sulfite concentration in the developer was small (sample Nos. 3-10, 3-11, 3-17, and 3-18), and thus the photographic properties were more stabilized in such cases.

TABLE 3

| Sample No. | Cyan Coupler (*) | Sodium Sulfite (g/l) | Additive (C) (0.04 mol/l) | Additive (D) (0.03 mol/l) | Developer | Variation of Photographic Property Dmin | Gradation |
|---|---|---|---|---|---|---|---|
| 3-1 | C-9 | 1.8 | II-15 | Triethanolamine | Comparison | +0.06 | +0.19 |
| 3-2 | C-1 | 1.8 | " | " | Comparison | +0.06 | +0.18 |
| 3-3 | " | 0 | " | " | " | +0.05 | +0.13 |
| 3-4 | (A) | 1.8 | " | I-1 | Present Invention | +0.03 | +0.10 |
| 3-5 | (B) | 1.8 | " | " | " | +0.03 | +0.08 |
| 3-6 | C-9 | 1.8 | " | " | " | +0.01 | +0.08 |
| 3-7 | C-1 | 1.8 | " | " | " | +0.01 | +0.09 |
| 3-8 | (A) | 0 | " | " | " | +0.03 | +0.07 |
| 3-9 | (B) | 0 | " | " | " | +0.03 | +0.06 |
| 3-10 | C-9 | 0 | " | " | " | 0 | +0.01 |
| 3-11 | C-1 | 0 | " | " | " | +0.01 | 0 |
| 3-12 | (A) | 1.8 | II-3 | I-11 | " | +0.03 | +0.07 |
| 3-13 | C-1 | 1.8 | " | " | " | +0.01 | +0.09 |
| 3-14 | (A) | 1.0 | " | " | " | +0.03 | +0.06 |
| 3-15 | C-1 | 1.0 | " | " | " | +0.01 | +0.06 |
| 3-16 | (A) | 0 | " | " | " | +0.03 | +0.05 |
| 3-17 | C-9 | 0 | " | " | " | 0 | 0 |

TABLE 3-continued

| Sample No. | Cyan Coupler (*) | Sodium Sulfite (g/l) | Additive (C) (0.04 mol/l) | Additive (D) (0.03 mol/l) | Developer | Variation of Photographic Property Dmin | Gradation |
|---|---|---|---|---|---|---|---|
| 3-18 | C-1 | 0 | " | " | " | 0 | 0 |

(*) Cyan Couplers (A) and (B) were as follows.

(*) Cyan Couplers:

(A)

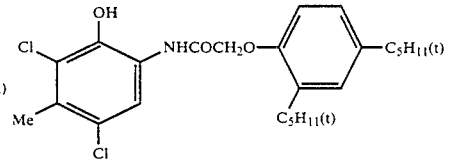

(B)

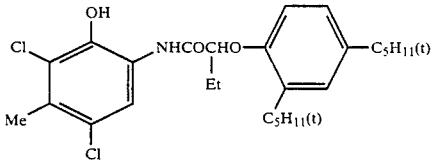

EXAMPLE 4

A multilayer photographic paper was prepared by forming the layers having the compositions shown below on a paper support both surfaces of which were coated with polyethylene. The coating compositions for the layers were prepared as follows.

Coating Composition for First Layer:

27.2 ml of ethyl acetate and 7.7 ml (8.0 g) of high boiling point organic solvent (Solv-(1)) were added to 10.2 g of yellow coupler (ExY-(1)) and 9.1 g of yellow coupler (ExY-(2)) and 4.4 g of color image stabilizer (Cpd-(1)) and dissolved, and the resulting solution was dispersed by emulsification in 185 ml of an aqueous 10 wt. % gelatin solution containing 8 ml of a 10 wt. % sodium dodecylbenzenesulfonate solution. The thus emulsified dispersion and Emulsions (EM1) and (EM2) were blended and dissolved and the gelatin concentration was adjusted as shown below to provide the coating composition for the first layer. Coating compositions for the second layer to the seventh layer were also prepared in the same manner as in the preparation of the coating composition for the first layer. As a gelatin hardening agent for each layer, 1-hydroxy-3,5-dichloro-s-triazine sodium salt was used.

As a tackifier, Compound (Cpd-(2)) was used.

The compositions of the layers were as follows. The number means the amount coated (g/m$^2$). The amount of the silver halide emulsion coated refers to the amount of silver therein.

Support:

Polyethylene-coated Paper (i.e., Polyethylene-laminated Paper), containing a white pigment ($TiO_2$) and a bluish dye in the polyethylene coat for the first layer.

| | |
|---|---|
| **First Layer: Blue-sensitive Emulsion Layer** | |
| Monodisperse Silver Chlorobromide Emulsion (EM1) (spectrally sensitized with Sensitizing Dye (ExS-(1)) | 0.13 |
| Monodisperse Silver Chlorobromide Emulsion (EM2) (spectrally sensitized with Sensitizing Dye (ExS-(1)) | 0.13 |
| Gelatin | 1.86 |
| Yellow Coupler (ExY-(1)) | 0.44 |
| Yellow Coupler (ExY-(2)) | 0.39 |
| Color Image Stabilizer (Cpd-(1)) | 0.19 |
| Solvent (Solv-(1)) | 0.35 |
| **Second Layer: Color Mixing Preventing Layer** | |
| Gelatin | 0.99 |
| Color Mixing Preventing Agent (Cpd-(3)) | 0.08 |
| **Third Layer: Green-sensitive Emulsion Layer** | |
| Monodisperse Silver Chlorobromide Emulsion (EM3) (spectrally sensitized with Sensitizing Dyes (ExS-(2), (3)) | 0.05 |
| Monodisperse Silver Chlorobromide Emulsion (EM4) (spectrally sensitized with Sensitizing Dyes (ExS-(2), (3)) | 0.11 |
| Gelatin | 1.80 |
| Magenta Coupler (ExM-(1)) | 0.39 |
| Color Image Stabilizer (Cpd-(4)) | 0.20 |
| Color Image Stabilizer (Cpd-(5)) | 0.02 |
| Color Image Stabilizer (Cpd-(6)) | 0.03 |
| Solvent (Solv-(2)) | 0.12 |
| Solvent (Solv-(3)) | 0.25 |
| **Fourth Layer: Ultraviolet Absorbent Layer** | |
| Gelatin | 1.60 |
| Ultraviolet Absorbent (Ratio of Cpd-(7)/Cpd-(8)/Cpd-(9) is 3/2/6, by weight) | 0.70 |
| Color Mixing Preventing Agent (Cpd-(10)) | 0.05 |
| Solvent (Solv-(4)) | 0.27 |
| **Fifth Layer: Red-sensitive Emulsion Layer** | |
| Monodisperse Silver Chlorobromide Emulsion (EM5) (spectrally sensitized with Sensitizing Dyes (ExS-(4), (5)) | 0.07 |
| Monodisperse Silver Chlorobromide Emulsion (EM6) (spectrally sensitized with Sensitizing Dyes (ExS-(4), (5)) | 0.16 |
| Gelatin | 0.92 |
| Cyan Coupler (ExC-(1)) | 0.32 |
| Color Image Stabilizer (Ratio of Cpd-(8)/Cpd-(9)/Cpd-(12) is 3/4/2, by weight) | 0.17 |
| Dispersing Polymer (Cpd-(11)) | 0.28 |
| Solvent (Solv-(2)) | 0.20 |
| **Sixth Layer: Ultraviolet Absorbing Layer** | |
| Gelatin | 0.54 |
| Ultraviolet Absorbent (Ratio of Cpd-(7)/Cpd-(9)/Cpd-(12) is 1/5/3, by weight) | 0.21 |
| Solvent (Solv-(2)) | 0.08 |
| **Seventh Layer: Protective Layer** | |
| Gelatin | 1.33 |
| Acry-modified Copolymer of Polyvinyl Alcohol (modification degree: 17%) | 0.17 |
| Liquid Paraffin | 0.03 |

As an anti-irradiation dye, Compounds (Cpd-(13), Cpd-(14) were used.

In addition, Alkanol XC (manufactured by Du Pont), sodium alkylbenzenesulfonate, succinic acid ester and Magefacx F-120 (manufactured by Dai-Nippon Ink & Chemicals Inc.) were used as an emulsification and dispersing agent and a coating assistant agent in each layer. As a stabilizer for silver halides, Compounds (Cpd-(15), and (16)) were used.

The details of the emulsions used were as follows:

| Emulsion | Grain Size (μm) | Br Content (mol %) | Variation Coefficient |
|---|---|---|---|
| EM1 | 1.0 | 80 | 0.08 |
| EM2 | 0.75 | 80 | 0.07 |
| EM3 | 0.5 | 83 | 0.09 |
| EM4 | 0.4 | 83 | 0.10 |
| EM5 | 0.5 | 73 | 0.09 |
| EM6 | 0.4 | 73 | 0.10 |

The structural formulae of the compounds that were used are as follows.

ExY-(1)

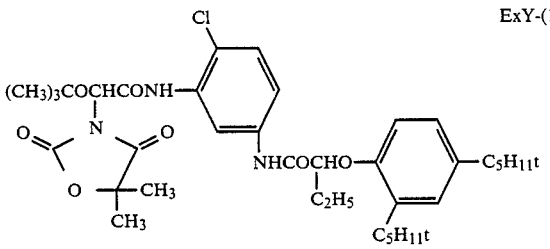

ExY-(2)

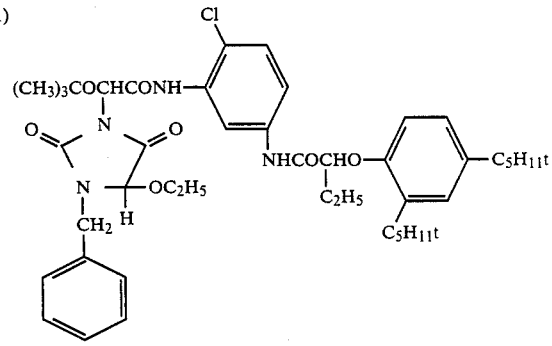

ExM-(1)

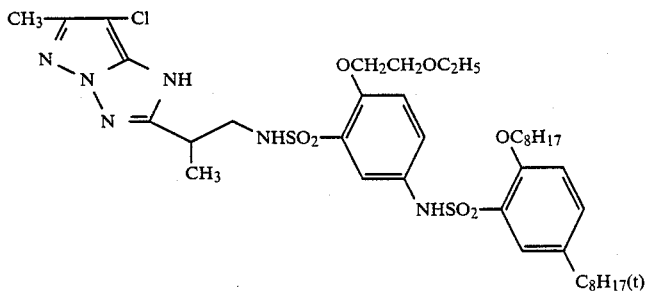

ExC-(1)

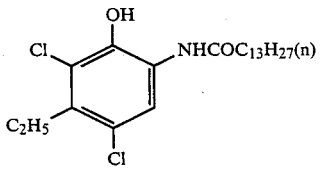

ExS-(1)

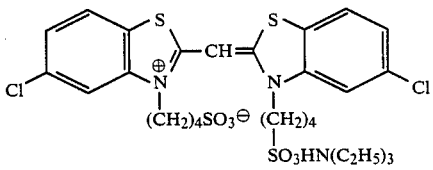

ExS-(2)

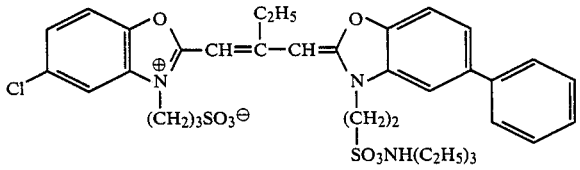

ExS-(3)

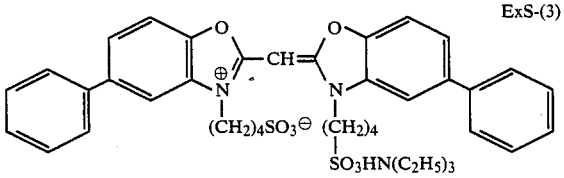

ExS-(4)

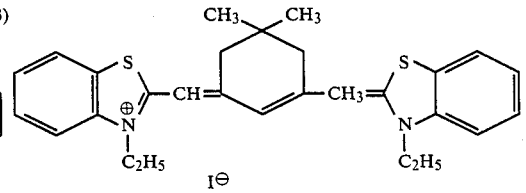

-continued
ExS-(5)
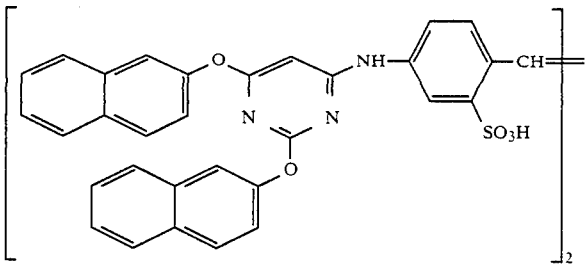
Cpd-(1)
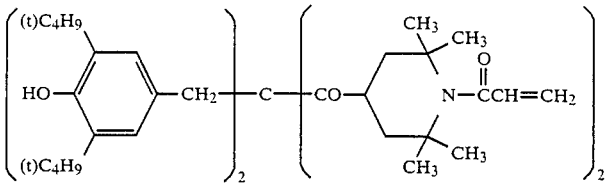
Cpd-(2)
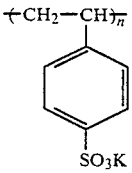
Cpd-(3)
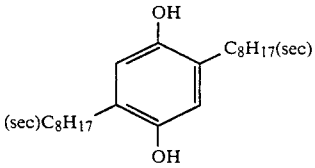
Cpd-(4)
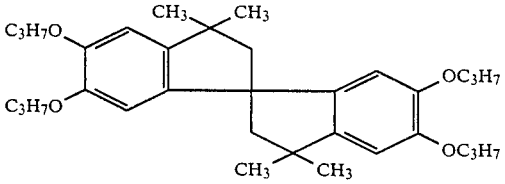
Cpd-(5)
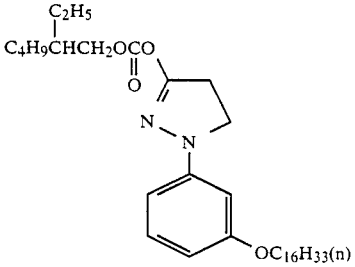
Cpd-(6)
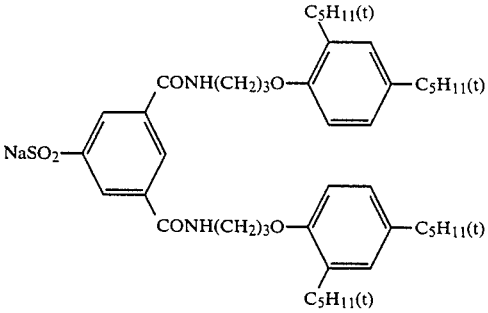
Cpd-(7)
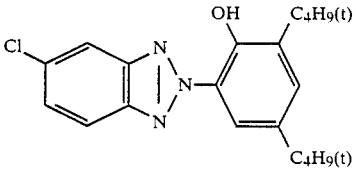
Cpd-(8)
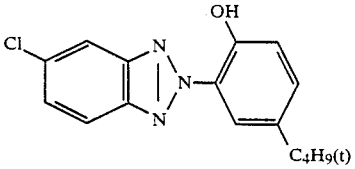
Cpd-(9)
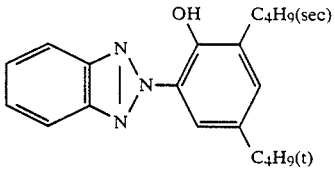
Cpd-(10)
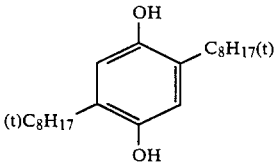
Cpd-(11)
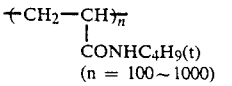

-continued

Cpd-(12)

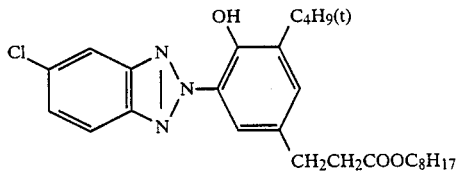

Dibutyl Phthalate Solv-(1) Tricresyl Phosphate Solv-(2)
Trioctyl Phosphate Solv-(3) Trinonyl Phosphate Solv-(4)

Cpd-(13)

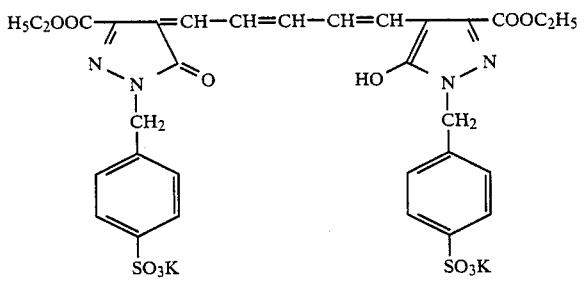

Cpd-(14)

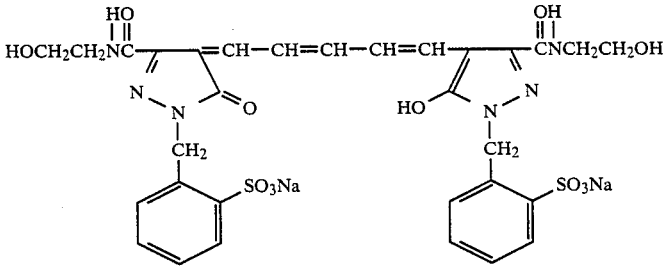

Cpd-(15)

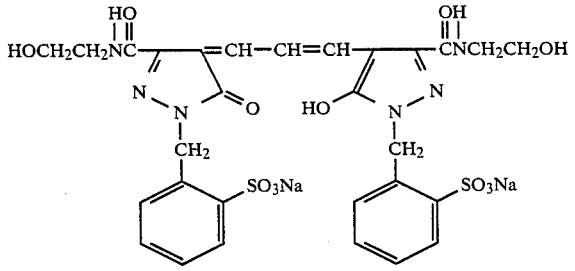

Cpd-(16)

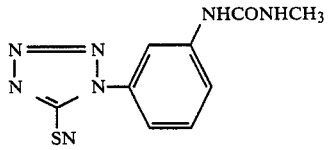

The above-described photographic paper was, after imagewise exposure, processed by the use of Fuji Color Paper Processing Machine PP600 manufactured by Fuji Photo Film Co., Ltd., in accordance with the processing procedure described below. The processing was carried out in the system of a continuous procedure (running test) until the amount of the replenisher added became two times of the capacity of the color developer tank.

| Processing Step | Temperature | Time | Amount of Replenisher(*) | Tank Capacity |
|---|---|---|---|---|
| Color Development | 38° C. | 1 min 40 sec | 290 ml | 17 liters |

-continued

| Processing Step | Temperature | Time | Amount of Replenisher(*) | Tank Capacity |
|---|---|---|---|---|
| Bleach-fixing | 33° C. | 60 sec | 150 ml | 9 liters |
| Rinsing (1) | 30 to 34° C. | 20 sec | — | 4 liters |
| Rinsing (2) | 30 to 34° C. | 20 sec | — | 4 liters |
| Rinsing (3) | 30 to 34° C. | 20 sec | 364 ml | 4 liters |
| Drying | 70 to 80° C. | 50 sec | — | — |

(*) Amount per $m^2$ of the photographic paper being processed.

The rinsing step was carried out by a 3 tank countercurrent system from the rinsing tank (3) to the rinsing tank (1).

The compositions of the respective processing solutions were as follows.

Color Developer:

| | Tank Solution | Replenisher |
|---|---|---|
| Water | 800 ml | 800 ml |
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Benzyl Alcohol | See TABLE 4 | |
| Diethylene Glycol | 10.0 ml | 10.0 ml |
| Sodium Sulfite | See Table 4 | |
| Potassium Bromide | 0.5 g | — |
| Potassium Carbonate | 30 g | 30 g |
| N—ethyl-N—(β-methanesulfonamidoethyl)3-methyl-4-aminoaniline.sulfate | 5.5 g | 7.5 g |
| N,N—diethylhydroxylamine | 4.0 g | 6.0 g |
| Additive (A) | See Table 4 | |
| Brightening Agent (WHITEX 4B, manufactured by Sumitomo Chemical Co.) | 1.5 g | 2.0 g |
| Water to make | 1000 ml | 1000 ml |
| pH (25° C.) | 10.20 | 10.60 |

Bleach-fixing Solution:

| | Tank Solution | Replenisher |
|---|---|---|
| Water | 400 ml | 400 ml |
| Ammonium Thiosulfate (70 wt. %) | 200 ml | 300 ml |
| Sodium Sulfite | 20 g | 20 g |
| Ammonium Ethylenediaminetetraacetic Acid/Iron(III) | 60 g | 120 g |
| Disodium Ethylenediaminetetraacetic Acid | 5 g | 10 g |
| Water to make | 1000 ml | 1000 ml |
| pH (25° C.) | 6.70 | 6.30 |

-continued

Rinsing Solution:

| | |
|---|---|
| Tank solution and replenisher were same. | |
| Benzotriazole | 1.0 g |
| Potassium Ethylenediamine-N,N,N',N'—tetramethylenephosphonate | 0.3 g |
| Water to make | 1000 ml |
| pH | 7.0 |

The value Dmin and the gradation were measured in each sample, at the time of the beginning of the running test and at the end of the running test. The variation of the value Dmin and the gradation between the beginning and the end was calculated in each sample. The results are shown in Table 4.

TABLE 4

| Sample No. | Benzyl Alcohol (ml/l) Tank Solution | Benzyl Alcohol (ml/l) Replenisher | Sodium Sulfite (g/l) Tank Solution | Sodium Sulfite (g/l) Replenisher | Additive (A) Tank Solution = Replenisher (g/l) | ΔDmin | ΔGradation | Note |
|---|---|---|---|---|---|---|---|---|
| 4-1 | 15 | 20 | 1.7 | 2.5 | Triethanolamine | +0.04 | +0.09 | Comparison |
| 4-2 | — | — | — | — | Triethanolamine | +0.04 | +0.06 | Comparison |
| 4-3 | — | — | 1.7 | 2.5 | Triethanolamine | +0.03 | +0.09 | Comparison |
| 4-4 | 15 | 20 | 1.7 | 2.5 | I-1 | +0.01 | +0.04 | Present Invention |
| 4-5 | — | — | 1.7 | 2.5 | I-1 | 0 | +0.03 | Present Invention |
| 4-6 | 15 | 20 | — | — | I-1 | +0.01 | +0.02 | Present Invention |
| 4-7 | — | — | 0.5 | 0.7 | I-1 | 0 | +0.02 | Present Invention |
| 4-8 | — | — | — | — | I-1 | 0 | 0 | Present Invention |
| 4-9 | — | — | — | — | I-5 | 0 | +0.01 | Present Invention |
| 4-10 | — | — | — | — | I-10 | 0 | +0.01 | Present Invention |
| 4-11 | 15 | 20 | 1.7 | 2.5 | I-11 | +0.01 | +0.04 | Present Invention |
| 4-12 | — | — | 1.7 | 2.5 | I-11 | 0 | +0.03 | Present Invention |
| 4-13 | 15 | 20 | — | — | I-11 | +0.02 | +0.01 | Present Invention |
| 4-14 | — | — | — | — | I-11 | 0 | 0 | Present Invention |

The results of Table 4 demonstrate that the variation of the value Dmin and the gradation was large in the comparative tests (Sample Nos. 4-1, 4-2 and 4-3), while the variation of the photographic properties was small in the tests of the present invention. In particular, preferred results were obtained in the tests where neither benzyl alcohol nor sulfite ion was used (Sample Nos. 4-8, 4-9, 4-10 and 4-14).

EXAMPLE 5

In the Sample No. 4-9 of Example 4, Compound (I-3), (I-6), (I-13) or (I-16) was used in place of Compound (I-5) and all the others were same. The same experiment was carried out, and the same good results were obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, which comprises treating said material after imagewise exposure with a color developer containing an aromatic primary amine developing agent and at least one compound represented by formula (I)

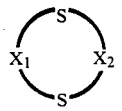

(I)

in which $X_1$ and $X_2$ each represents a divalent organic group.

2. A method for processing a silver halide color photographic material as in claim 1, wherein $X_1$ and $X_2$ in formula (I) are the same or different and each represents a substituted or unsubstituted alkylene group having from 2 to 10 carbon atoms, a substituted or unsubstituted alkenylene group having from 2 to 10 carbon atoms, a substituted or unsubstituted arylene group having from 6 to 10 carbon atoms or a group comprising the combination of these groups, in which said substituted alkylene, alkenylene or arylene group contains one or more substituents selected from the group consisting of a halogen atom, an alkyl group, an aryl group, an alkoxy group, an aryloxy group, a sulfonyl group, a sulfonamido group, a sulfamoyl group, a carbamoyl group, an amido group, a ureido group, an alkoxycarbonylamino group, an acyl group, a formyl group, a cyano group, a carboxyl group, a sulfo group, a hydroxyl group, a nitro group, an alkylthio group, an arylthio group and an amino group.

3. A method for processing a silver halide color photographic material as in claims 1, wherein $X_1$ and $X_2$ in formula (I) each represents a substituted or unsubstituted alkylene group having from 2 to 10 carbon atoms.

4. A method for processing a silver halide color photographic material as in claim 1, wherein the color developer contains one or more compounds represented by formula (I-I) as the compound of formula (I)

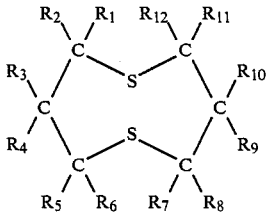

(I-I)

in which $R_1$ to $R_{12}$ each represents a hydrogen atom or a substituent of $X_1$ or $X_2$.

5. A method for processing a silver halide color photographic material as in claim 4, wherein $R_1$ to $R_{12}$ in formula (I-I) each represents a hydrogen atom, a halogen atom, an alkyl group, an alkoxy group, a hydroxyl group, a carboxyl group, a sulfo group, a nitro group or an alkylthio group.

6. A method for processing a silver halide color photographic material as claim 1, wherein the color developer further contains a hydroxylamine represented by formula (II)

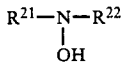

(II)

in which $R^{21}$ and $R^{22}$ each represents a hydrogen atom, an unsubstituted or substituted alkyl group, an unsubstituted or substituted alkenyl group or an unsubstituted or substituted aryl group, or $R^{21}$ and $R^{22}$ together with the nitrogen atom of formula (II) form a heterocyclic group.

7. A method for processing a silver halide color photographic material as in claim 1, wherein the color developer further contains a hydroxamic acid of a formula (III)

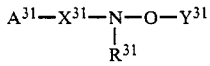

(III)

in which $A^{31}$ represents a hydrogen atom, or an unsubstituted or substituted alkyl group, aryl group, maino group, heterocyclic group, alkoxy group, aryloxy group, carbamoyl group, sulfamoyl group, acyl group, carboxyl group, hydroxamino group or hydroxyaminocarbonyl group;

$X^{31}$ represents

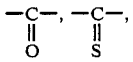

—$SO_2$— or —SO—;

$R^{31}$ represents a hydrogen atom, or an unsubstituted or substituted alkyl group, or aryl group; or $A^{31}$ and $R^{31}$ together form a cyclic structure; and $Y^{31}$ represents a hydrogen atom or a group capable of becoming a hydrogen atom by hydrolysis.

8. A method for processing a silver halide color photographic material as claim 1, where the color developer further contains a hydrazine or hydrazide represented by a formula (IV)

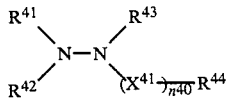

(IV)

in which $R^{41}$, $R^{42}$ and $R^{43}$ each represents a hydrogen atom, or an unsubstituted or substituted alkyl group, aryl group or heterocyclic group;

$R^{44}$ represents a hydroxyl group, a hydroxyamino group, or an unsubstituted or substituted alkyl group, aryl group, heterocyclic group, alkoxy group, aryloxy group, carbamoyl group or amino group;

$X^{41}$ represents —CO—, —$SO_2$— or

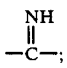

$n^{40}$ represents 0 or 1; and $R^{43}$ and $R^{44}$ together form a heterocyclic ring.

9. A method for processing a silver halide color photographic material as in claim 1, wherein the color developer further contains a phenol represented by formula (V)

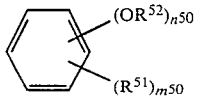

(V)

in which $R^{51}$ represents a hydrogen atom, a halogen atom, or an unsubstituted or substituted alkyl group, alkoxy group, aryl group, aryloxy group, carboxyl group, sulfo group, carbamoyl group, sulfamoyl group, amido group, sulfonamido group, ureido group, alkylthio group, arylthio group, nitro group, cyano group, amino group, formyl group, acyl group, sulfonyl group, alkoxycarbonyl group, aryloxycarbonyl group, alkoxysulfonyl group or aryloxysulfonyl group; and when m is two or more, $R^{51}$ groups may be the same or different, and two adjacent $R^{51}$ groups may form a 5-or 6-membered ring;

$R^{52}$ represents a hydrogen atom or a hydrolyzable group; and $m^{50}$ and $n^{50}$ each represent an integer of from 1 to 5.

10. A method for processing a silver halide color photographic material as in claim 1, wherein said material contains at least one cyan coupler represented by a formula (C-I)

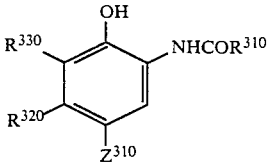

(C-I)

in which $R^{310}$ represents an unsubstituted or substituted alkyl group, cycloalkyl group, aryl group, amino group or heterocyclic group;

$R^{320}$ represents an unsubstituted or substituted acylamino group or alkyl group having 2 or more carbon atoms;

$R^{330}$ represents a hydrogen atom, a halogen atom, or an unsubstituted or substituted alkyl group or alkoxy group; or $R^{330}$ is bonded with $R^{320}$ to form a ring; and $Z^{310}$ represents a hydrogen atom, a halogen atom, or a group capable of being released by reaction with the oxidation product of the aromatic primary amine color developing agent in the color developer.

11. A method for processing a silver halide color photographic material as in claim 1, wherein the color developer contain benzyl alcohol in the content of 2 ml or less per liter of the color developer.

12. A method for processing a silver halide color photographic material as in claim 1, wherein the color developer contains at least one compound represented by formula (I) in an amount of from 0.05 to 50 g per liter of the developer.

13. A method for processing a silver halide color photographic material as in claim 4, said compound represented by formula (I-I) is present in an amount from 0.05 g to 50 g per liter of the developer.

14. A method for processing a silver halide color photographic material as in claim 4, said compound represented by formula (I-I) is present in an amount from 0.1 g to 20 g per liter of the developer.

15. A color developing composition for treating a silver halide color photographic material after imagewise exposure which comprises containing an aromatic primary amine developing agent and at least one compound represented by formula (I)

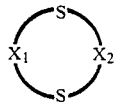

(I)

in which $X_1$ and $X_2$ each represents a divalent organic group.

16. A color developing composition for treating a silver halide color photographic material after imagewise exposure as in claim 15, wherein said color developer contains one or more compounds represented by formula (I-I) as the compound of formula (I)

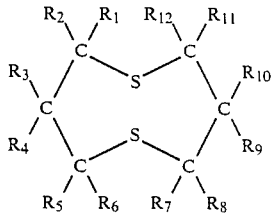

(I-I)

in which $R_1$ to $R_{12}$ each represents a hydrogen atom or a substituent of $X_1$ or $X_2$.

17. A color developing composition for treating a silver halide color photographic material after imagewise exposure as in claim 15, wherein said color developer further contains a hydroxylamine represented by formula (II)

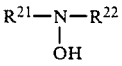

(II)

in which $R^{21}$ and $R^{22}$ each represents a hydrogen atom, an unsubstituted or substituted alkyl group, an unsubstituted or substituted alkenyl group or an unsubstituted or substituted aryl group, or $R^{21}$ and $R^{22}$ together with the nitrogen atom of formula (II) form a heterocyclic group.

18. A color developing composition for treating a silver halide color photographic material after image exposure as in claim 15, wherein said color developer contains benzyl alcohol in the content of 2 ml or less per liter of said color developer.

* * * * *